US007890011B2

(12) United States Patent
Suzuki

(10) Patent No.: US 7,890,011 B2
(45) Date of Patent: Feb. 15, 2011

(54) IMAGE FORMING APPARATUS INCLUDING INFORMATION DISPLAY FOR CONSUMABLES

(75) Inventor: Makoto Suzuki, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 364 days.

(21) Appl. No.: 11/905,229

(22) Filed: Sep. 28, 2007

(65) Prior Publication Data

US 2008/0080887 A1 Apr. 3, 2008

(30) Foreign Application Priority Data

Sep. 29, 2006 (JP) ..... 2006-269887

(51) Int. Cl.
*G03G 15/00* (2006.01)

(52) U.S. Cl. ..... 399/81; 399/24; 399/27

(58) Field of Classification Search ..... 399/24, 399/27–30, 81
See application file for complete search history.

(56) References Cited

U.S. PATENT DOCUMENTS

| | | | | |
|---|---|---|---|---|
| 5,847,857 | A * | 12/1998 | Yajima et al. | 358/468 |
| 6,048,045 | A | 4/2000 | Nohata et al. | |
| 7,314,259 | B2 | 1/2008 | Fujinaga | |
| 2001/0055493 | A1* | 12/2001 | Asanuma et al. | 399/25 |
| 2005/0146743 | A1* | 7/2005 | Firooz | 358/1.15 |
| 2005/0195231 | A1* | 9/2005 | Kasamatsu | 347/14 |
| 2006/0171724 | A1* | 8/2006 | Yamanaka | 399/8 |

FOREIGN PATENT DOCUMENTS

| | | | |
|---|---|---|---|
| JP | 9-98243 | | 4/1997 |
| JP | 9-269702 | A | 10/1997 |
| JP | 2000-287014 | A | 10/2000 |
| JP | 2001-83750 | A | 3/2001 |
| JP | 2002-103753 | | 4/2002 |
| JP | 2003-125156 | A | 4/2003 |
| JP | 2005-096241 | | 4/2005 |
| JP | 2005-316053 | A | 11/2005 |

* cited by examiner

*Primary Examiner*—David M Gray
*Assistant Examiner*—G. M. Hyder
(74) *Attorney, Agent, or Firm*—Baker Botts LLP

(57) ABSTRACT

An image forming apparatus includes a plurality of functions including a function of executing an operation involving use of a consumable, a selecting unit that selects one function from the plurality of functions, a detector that detects a remaining level of the consumable and a controller. The controller is operable to switch displayed contents to information corresponding to the one function when the one function is selected, instruct execution of an operation corresponding to the changed displayed information, display a warning indication when the remaining level of the consumable is not more than a predetermined level, determine whether the selected one function is the function of executing the operation involving use of the consumable, and inhibit the switching the displayed contents when one function is selected and is determined to be the function of executing the operation involving use of the consumable while the warning indication is displayed.

18 Claims, 13 Drawing Sheets

FIG. 3

14a

| FUNCTION | 14a1 USER 0 | 14a2 USER 1 | 14a3 USER 2 |
|---|---|---|---|
| FACSIMILE TRANSMISSION FUNCTION | ALLOWED | ALLOWED | NOT ALLOWED |
| FACSIMILE RECEIVING FUNCTION | ALLOWED | ALLOWED | NOT ALLOWED |
| MONOCHROME COPYING FUNCTION | ALLOWED | ALLOWED | ALLOWED |
| COLOR COPYING FUNCTION | ALLOWED | NOT ALLOWED | ALLOWED |
| MONOCHROME PRINTING FUNCTION | ALLOWED | ALLOWED | ALLOWED |
| COLOR PRINTING FUNCTION | ALLOWED | NOT ALLOWED | ALLOWED |
| SCANNER FUNCTION | ALLOWED | ALLOWED | ALLOWED |

IMAGE FORMING APPARATUS INCLUDING INFORMATION DISPLAY FOR CONSUMABLES

CROSS-REFERENCE TO RELATED APPLICATIONS

This application claims priority from Japanese Patent Application No. 2006-269887 filed on Sep. 29, 2006, the entire subject matter of which is incorporated herein by reference.

TECHNICAL FIELD

Aspects of the present invention relate to an image forming apparatus which has a plurality of functions, and more particularly to an image forming apparatus including a function of executing an operation involving use of a consumable.

BACKGROUND

There has been proposed an image forming apparatus which employs an imaging substance such as color toner or black toner to form color or monochrome images on a recording medium (e.g., see JP-A-2001-83750). The imaging substance used in such an image forming apparatus is a consumable supply. Thus, images cannot be formed when no remaining imaging substance is available. In this context, when it is detected that no remaining imaging substance is available, a warning is indicated.

For example, JP-A-2001-83750 discloses an image forming apparatus that displays a message (warning indication), "No yellow toner available," when it is detected that yellow toner is not available. In addition, when it is detected that yellow toner is not available, a message "Copying in monochrome available" is also displayed on the operation screen together with the above-described message.

However, such a warning indication as provided for the remaining level shortage of a consumable that is not necessary to perform a function desired by a user would lead to a user's operating comfort being compromised or cause the user to feel frustration. For example, a user who desires color printing requires a warning indication that no color toner is available. However, another user who desires not color printing but monochrome printing would often feel frustrated of the warning indication that no color toner is available.

Further, there exists an image forming apparatus with a small display screen which can display only one or two lines of text due to the limited design space, etc. When a warning indication is displayed on such a small display screen, other information cannot be displayed. For this reason, a user who uses an image forming apparatus with a small display screen tends to further feel frustrated of an unnecessary warning indication every time the warning indication is displayed.

SUMMARY

Aspects of the present invention provide an image forming apparatus which improves the user's feeling of operating ease and operability by improving the method for presenting a warning indication.

BRIEF DESCRIPTION OF THE DRAWINGS

FIG. 3 is an exemplary schematic diagram of a user's usage restricting table stored in a ROM;

DETAILED DESCRIPTION

<General Overview>

Figure 1:
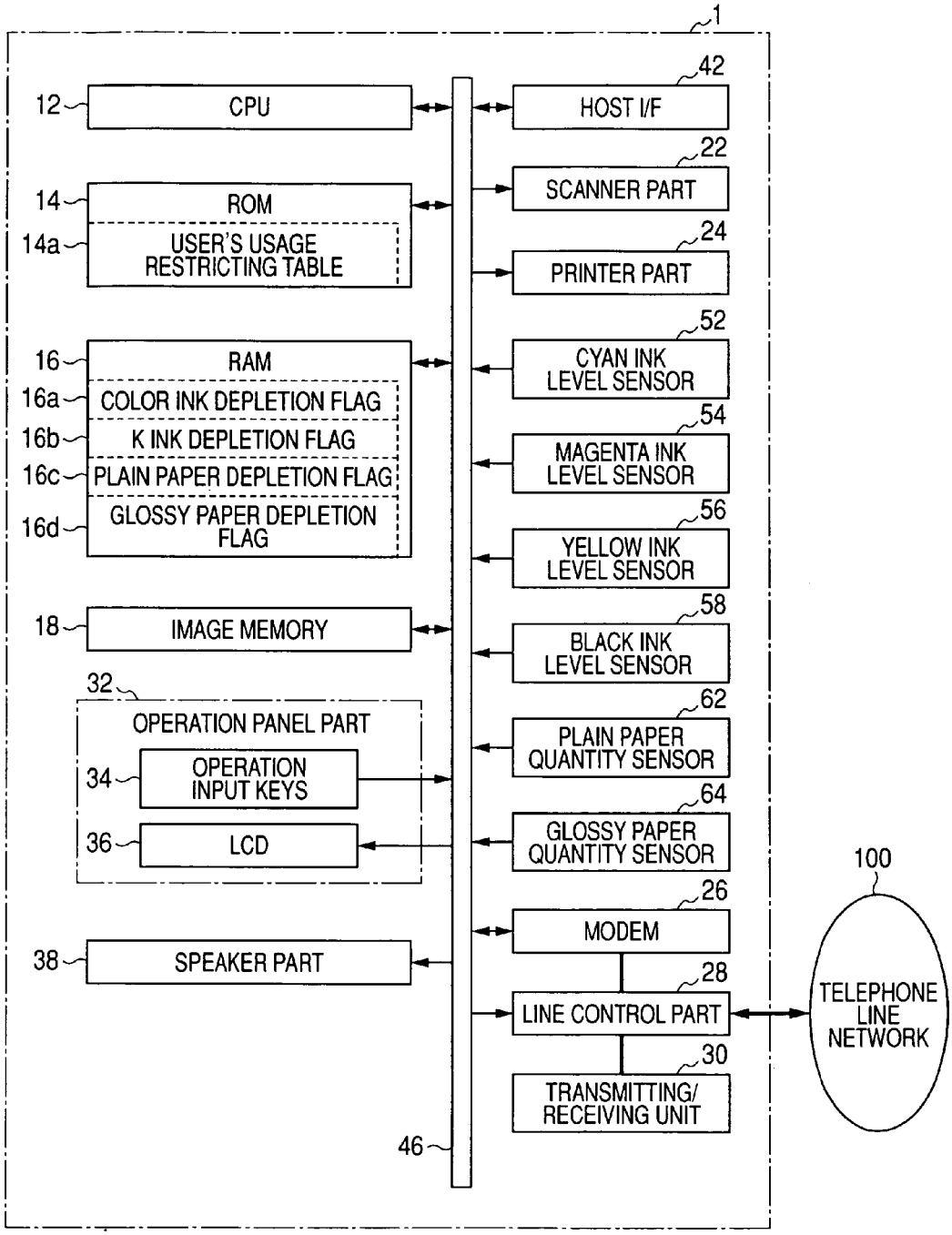
FIG. 1 is an exemplary block diagram of an MFD according to an aspect of the present invention.

According to an aspect of the invention, there is provided an image forming apparatus including a plurality of functions that include a function of executing an operation involving use of a consumable, the image forming apparatus including: a display; a selecting unit that selects one function to be executed from the plurality of functions; a detector that detects a remaining level of the consumable; and a controller that is operable to: switch contents displayed on the display to information corresponding to the one function when the one function is selected by the selecting unit; instruct execution of an operation corresponding to the information displayed on the display as a result of the switching the contents; display a warning indication on the display when the remaining level of the consumable is detected to be equal to or less than a predetermined level; determine whether the one function selected by the selecting unit is the function of executing the operation involving use of the consumable, the one function being targeted for the warning indication; and inhibit the switching the contents displayed on the display when one function is selected by the selecting unit and is determined to be the function of executing the operation involving use of the consumable while the warning indication is displayed on the display, wherein the controller switches the contents displayed on the display when one function is selected by the selecting unit and is determined not to be the function of executing the operation involving use of the consumable while the warning indication is displayed on the display.

According to another aspect of the invention, there is provided a method for controlling an image forming apparatus, the image forming apparatus including a plurality of functions including a function of executing an operation involving use of a consumable, the method including: selecting one function to be executed from the plurality of functions by a selecting unit; switching contents displayed on a display to information corresponding to the one function when the one function is selected; instructing execution of an operation corresponding to the information displayed on the display as a result of the switching the contents; detecting a remaining level of the consumable; displaying a warding indication on the display when the remaining level of the consumable is detected to be equal to or less than a predetermined level;

determining whether the one function selected by the selecting unit is the function of executing the operation involving use of the consumable, the one function being targeted for the warning indication; inhibiting the switching the contents displayed on the display when one function is selected by the selecting unit and is determined to be the function of executing the operation involving use of the consumable while the warning indication is displayed on the display; and switching the contents displayed on the display when one function is selected by the selecting unit and is determined not to be the function of executing the operation involving use of the consumable while the warning indication is displayed on the display.

According to still another aspect of the invention, there is provided an image forming apparatus including a plurality of functions that include a function of executing an operation involving use of a consumable, the image forming apparatus including: a display; executed function selecting means for selecting one function to be executed from the plurality of functions; display switching means for switching contents displayed on the display to information corresponding to the one function when the one function is selected by the executed function selecting means; executed operation instructing means for instructing execution of an operation corresponding to the information displayed on the display as a result of the switching by the display switching means; remaining level detection means for detecting a remaining level of the consumable; warning indication provision means for displaying a warning indication on the display when the remaining level of the consumable detected by the remaining level detection means equal to or less than a predetermined level; function determination means for determining whether the one function selected by the executed function selecting means is the function of executing the operation involving use of the consumable, the one function being targeted for the warning indication; and display switching inhibiting means for inhibiting the display switching means from switching the contents displayed on the display when one function is selected by the executed function selecting means and is determined to be the function of executing the operation involving use of the consumable by the function determination means while the warning indication is displayed on the display by the warning indication provision means, wherein the display switching means switches the contents displayed on the display when one function is selected by the selecting unit and is determined not to be the function of executing the operation involving use of the consumable while the warning indication is displayed on the display by the warning indication provision means.

<Illustrative Aspects>

Illustrative aspects of the present invention will be described below with reference to the accompanying drawings. FIG. 1 is an exemplary block diagram of a multi-function peripheral device (hereinafter referred to as multi function device (MFD)) 1 according to an aspect of the present invention. As a single unit, the MFD 1 includes various types of functions such as a facsimile function (facsimile transmission function and facsimile receiving function) for implementing the facsimile network service via a telephone line network 100 and a voice call function for implementing voice calls via the telephone line network 100. The MFD 1 also includes a printing function (color printing function and monochrome printing function), a copying function (color copying function and monochrome copying function), and a scanner function. The MFD 1 further includes a user lock function, so that the user lock function restricts those functions available to each logged-in user.

As shown in FIG. 1, the MFD 1 includes a CPU 12 for controlling the entire operation of the MFD 1, a ROM 14 which stores various types of control programs executed by the CPU 12 and default data and has a user's usable function restricting table 14*a* to be described later, a RAM 16 serving as a memory for temporarily storing data and programs necessary for various processes executed by the CPU 12, an image memory 18, a scanner part 22, a printer part 24, a cyan ink level sensor 52, a magenta ink level sensor 54, a yellow ink level sensor 56, a black ink level sensor 58, a plain paper quantity sensor 62, a glossy paper quantity sensor 64, a modem 26, a line control part 28, a transmitting/receiving unit 30 which is removable from the main body of the MFD 1 and used for transmitting and receiving calls in the voice call function, an operation panel part 32 with operation input keys 34 and a liquid crystal display (LCD) 36, a speaker part 38 having a loudspeaker and a drive circuit for driving the loudspeaker, and a host I/F 42 serving as an interface which provides access to external control devices such as personal computers.

Of these components, the CPU 12, the ROM 14, the RAM 16, the image memory 18, the scanner part 22, the printer part 24, the cyan ink level sensor 52, the magenta ink level sensor 54, the yellow ink level sensor 56, the black ink level sensor 58, the plain paper quantity sensor 62, the glossy paper quantity sensor 64, the modem 26, the line control part 28, the operation part 34, the LCD 36, the speaker part 38, the host I/F 42, and an USB I/F 44 are connected to each other via a bus line 46. Note that the line control part 28 and the modem 26 or the transmitting/receiving unit 30 are connected to each other via a transmission path to be described later.

As shown in FIG. 1, the RAM 16 provided in the MFD 1 includes a color ink depletion flag 16*a*, a K ink depletion flag 16*b*, a plain paper depletion flag 16*c*, and a glossy paper depletion flag 16*d*.

The color ink depletion flag 16*a* indicates whether there is a remaining quantity of a color ink. The color ink depletion flag 16*a* being ON indicates that no remaining quantity of the color ink is available, whereas it being OFF indicates that some remaining quantity of the color ink is available. Note that as used herein, the term "color ink" refers to an ink except for a black ink that enables monochrome printing.

The color ink depletion flag 16*a* is initialized (turned OFF) by turning ON the power supply to the MFD 1, and is then turned ON in an initial screen display process (see FIG. 5) and an ink level error display process (see FIG. 9), to be described later, when at least one colorant of a cyan ink, a magenta ink, and a yellow ink is detected to have no remaining quantity. Note that as used herein, the expression "no remaining quantity" is not intended to mean that the remaining quantity is zero but that the remaining quantity is equal to or less than a prescribed level.

The K ink depletion flag 16*b* indicates whether there is a remaining quantity of black ink. The K ink depletion flag 16*b* being ON indicates that no remaining quantity of the black ink is available, whereas it being OFF indicates that some remaining quantity of the black ink is available. The K ink depletion flag 16*b* is initialized (turned OFF) by turning ON the power supply to the MFD 1, and is then turned ON in the initial screen display process (see FIG. 5) and the ink level error display process (see FIG. 9), to be described later, when the black ink is detected to have no remaining quantity.

The plain paper depletion flag 16*c* and the glossy paper depletion flag 16*d* indicate whether a remaining quantity of plain paper held in a plain paper sheet feed tray (not shown) is available and whether a remaining quantity of glossy paper held in a glossy paper sheet feed tray (not shown) is available, respectively. The plain paper depletion flag 16*c* being ON would indicate that no remaining quantity of plain paper is available, whereas it being OFF would indicate that some remaining quantity of plain paper is available. Similarly, the glossy paper depletion flag 16*d* being ON would indicate that no remaining quantity of glossy paper is available, whereas it being OFF would indicate that some remaining quantity of plain paper is available. Both the plain paper depletion flag 16*c* and the glossy paper depletion flag 16*d* is once initialized (turned OFF) at the beginning of a recording sheet quantity detection process (see FIG. 11), to be described later. Then, when at least one of these types of recording sheet is detected to have no remaining quantity, the corresponding one of the flags 16*c* and 16*d* is turned ON.

The image memory 18 is made up of a dynamic RAM (DRAM) as a bulk memory. The image memory 18 once stores image data produced based on facsimile data received via the telephone line network 100 from the device at the other end of the line or image data produced by the reading operation of the scanner part 22 when the MFD 1 serves as a facsimile. Note that the image data stored in the image memory 18 upon receiving by the facsimile is erased when the image data is printed on recording sheet by the printer part 24. On the other hand, the image data stored in the image memory 18 upon transmission by the facsimile is erased when the facsimile data produced from the image data is transmitted via the telephone line network 100 to the device at the other end of the line.

The scanner part 22 includes an image reading sensor (not shown) for reading images from the original document held at the predetermined reading position (not shown) in accordance with the instruction from the CPU 12 and producing image data of the images.

The printer part 24 is made up of an ink jet printer for printing on recording sheet held at predetermined sheet feed position (not shown) in accordance with the instruction from the CPU 12, including a recording sheet feed motor (not shown) for conveying recording sheet, a print head (not shown) for dispensing ink onto the recording sheet, and a carriage motor (not shown) for reciprocating a carriage (not shown) mounted with the print head.

In addition, the printer part 24 includes an ink cartridge mount part (not shown) for mounting ink cartridges in which inks to be supplied to the print head (not shown) are filled. The ink cartridge mount part of the MFD 1 adapted to use inks of four colors (cyan, magenta, yellow, and black) is configured such that four types of ink cartridges each having one color ink filled therein are separately removable.

Furthermore, the printer part 24 includes a sheet feed tray (not shown) for holding recording sheet. The MFD 1 has a plain paper sheet feed tray intended only for holding plain paper and a glossy paper sheet feed tray intended only for holding glossy paper.

The cyan ink level sensor 52, the magenta ink level sensor 54, the yellow ink level sensor 56, and the black ink level sensor 58 detect the level of remaining ink in the corresponding ink cartridge mounted in the ink cartridge mount part, respectively. All the remaining level sensors 52, 54, 56, and 58 are optical sensors which include a light-emitting part (not shown) for emitting infrared light and a light-receiving part (not shown) for receiving reflected infrared light. The optical sensor is adapted such that the light-emitting part emits infrared light into a predetermined position on the light-transmitting part of the ink cartridge, and the light-receiving part receives the reflected light, so that the presence or absence of the ink is detected based on the received amount of the reflected light.

The plain paper quantity sensor 62 and the glossy paper quantity sensor 64 are limit type sensors which detect the remaining quantity of plain paper held in the plain paper sheet feed tray (not shown) and the remaining quantity of glossy paper held in the glossy paper sheet feed tray (not shown), respectively.

In accordance with the instruction from the CPU 12, the modem 26 modulates image data produced in the scanner part 22 to create image signals that can be transmitted to telephone line network 100 via the line control part 28, and demodulates image signals supplied over the telephone line 100 via the line control part 28 to image data.

The line control part 28 receives various signals from the telephone line network 100 and sends signals to the telephone line network 100, and sets a transmission path between a transmission destination and a transmission source for signals to be received from and sent to the telephone line network 100, in accordance with the instruction from the CPU 12. The "transmission path" includes paths to the modem 26 which are defined when operation is provided to send images (facsimile data) on the operation part 34 or when image signals (facsimile data) are received from the telephone line network 100. When a path to the modem 26 is set in this manner, image signals can now transmit through such a path. On the other hand, the transmission path that is set as such is released when the modem 26 has finished sending image signals or when it has finished receiving image signals from the telephone line 100, thereby no image signals are caused to transmit through the path. On the other hand, another transmission path includes a path from the line control part 28 to the transmitting/receiving unit 30 which is set when an operation of lifting the transmitting/receiving unit 30 off the hook (off-hook operation) is carried out on the main body part of the MFD 1. When a path from the line control part 28 to the transmitting/receiving unit 30 is set in this manner, voice signals can now transmit over the path. The transmission path that is set as such is released when an operation of putting down the transmitting/receiving unit 30 (on-hook operation) is conducted on the main body part of the MFD 1, thereby no voice signals are caused to transmit through the path.

Figure 2:
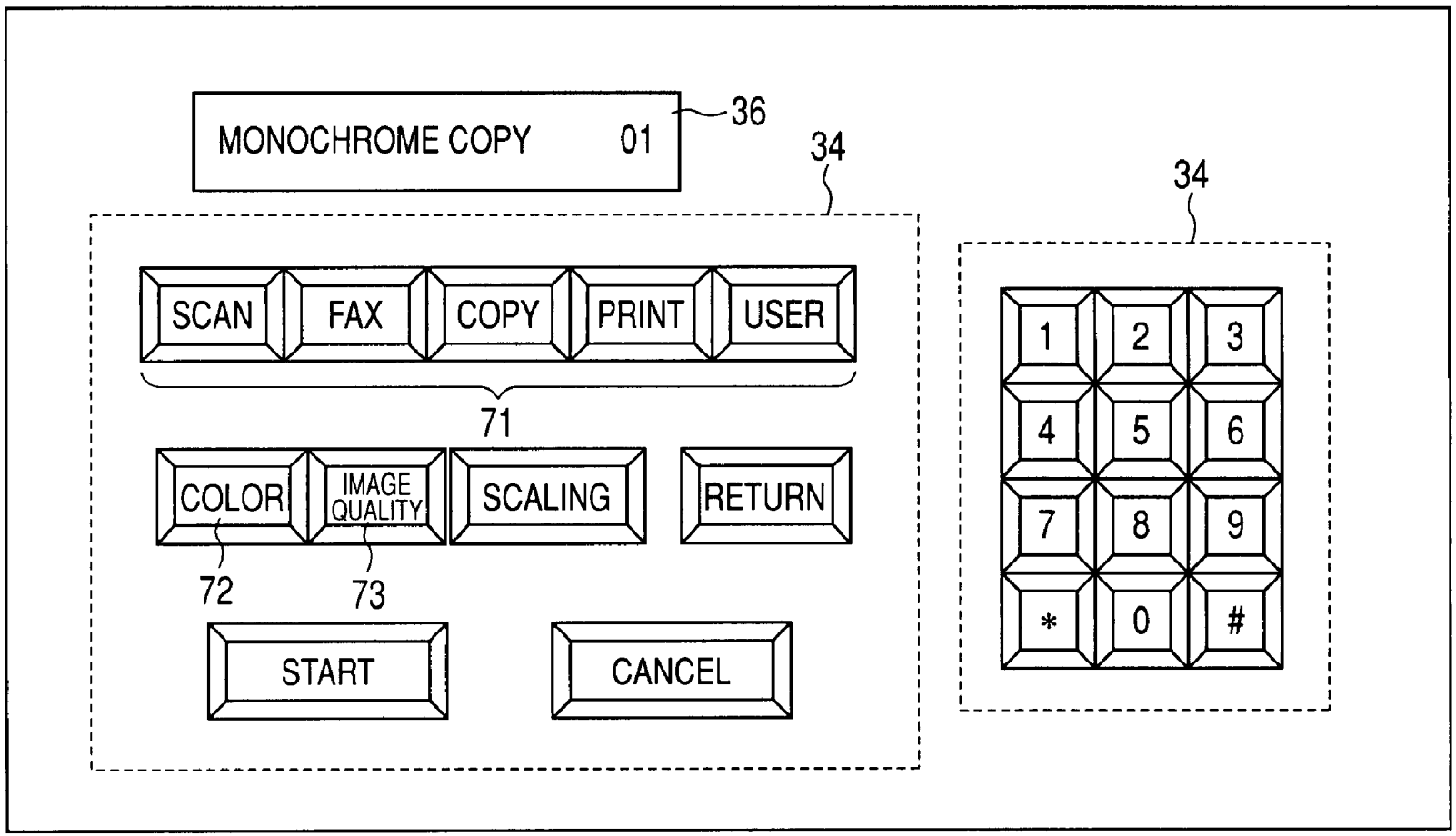
FIG. 2 is an exemplary schematic diagram of an operation panel.

FIG. 2 is an exemplary schematic diagram of the operation panel part 32. The operation panel part 32 serves as a man interface of the MFD 1. The operation panel part 32 is configured such that the user can use the operation panel part 32 for the MFD 1 to execute various types of functions.

As shown in FIG. 2, the operation panel part 32 is provided on its each part with a plurality of operation input keys 34 with which the operator can operate (push) so as to provide operation instructions to the MFD 1. The operation panel part 32 is provided on its upper left part with one-line display type LCD 36 for displaying various types of information regarding the MFD 1.

As shown in FIG. 2, the MFD 1 is provided on the operation panel 32 with a plurality of operation input keys 34 such as numerical keys for inputting characters and numerals, SCALING key for zooming in or out an original image for a print image, RETURN key for inputting a determination, START key for starting various types of processes or operations, and CANCEL key for canceling a process or operation during its execution.

In addition, the operation panel 32 of the MFD 1 is provided, in addition to those keys described above, with operation input keys 34 such as five FUNCTION keys 71, COLOR key 72, and IMAGE QUALITY key 73.

FUNCTION keys 71 are keys for instructing the function of running the MFD 1. FUNCTION keys 71 include SCAN key for instructing the execution of the scan function, FAX key for instructing the execution of the facsimile function, COPY key for instructing the execution of the copying function, PRINT key for instructing the execution of the printing function, and USER key for instructing the user change function of changing the user setting employed by the user lock function.

COLOR key 72 is a key for providing a color setting for color printing or monochrome printing upon performing printing by the printing part 24. Each time COLOR key 72 is pushed, an indication "color printing" or "monochrome printing" is displayed alternately on the LCD 36. If the user pushes the RETURN key (one of the operation input keys 34) when his or her desired color setting is displayed on the LCD 36, the change to the desired color setting is finally made.

IMAGE QUALITY key 73 is a key for setting the quality of an image to be printed by the printing part 24. Each time IMAGE QUALITY key 73 is pushed, such indications as "Fine" denoting a high quality image setting, "Text" denoting a standard quality image setting, and "Auto" denoting an automatic setting are sequentially displayed on the LCD 36. If the user pushes the RETURN key when a user's desired image quality setting is displayed on the LCD 36, the change to the image quality setting is finally made.

In addition, information regarding the state of the MFD 1 is displayed on the LCD 36. For example, when the MFD 1 is in a copy ready state, the indication of "monochrome copy 01" (ready screen) is displayed on the LCD 36, as shown in FIG. 2. When an operation input instruction is entered on the operation input keys 34, an indication character string (e.g., the indication of "Printing" or the indication of a numerical value entered as a parameter) corresponding to the input operation instruction is also displayed in addition to the indication of the ready screen shown in FIG. 2. When an error such as the shortage of remaining ink occurs, an error indication (e.g., "No color ink available") is displayed corresponding to the error.

The MFD 1 further includes the user lock function as described above, and those functions which each user is permitted to use and inhibited from using are controlled in the user's usage restricting table 14*a* of the ROM 14. Now, with reference to FIG. 3, such a user's usage restricting table 14*a* will be described. FIG. 3 is an exemplary schematic diagram of the user's usage restricting table 14*a* stored in the ROM 14.

As shown in FIG. 3, the user's usage restricting table 14*a* stores a first user or "User 0" (Column 14*a*1), a second user or "User 1" (Column 14*a*2), and a third user or "User 2" (Column 14*a*3), which correspond to the state of permission for use of seven functions ("the facsimile transmission function," "the facsimile receiving function," "the monochrome copying function," "the color copying function," "the monochrome printing function," "the color printing function," and "the scanner function"), respectively. For example, since User 0 is "Allowed" for all the seven functions as stored in the user's usage restricting table 14*a*, the user lock function permits User 0 to use all of these seven functions during login. On the other hand, as stored therein, User 1 is "Allowed" for five functions (the facsimile transmission function, the facsimile receiving function, the monochrome copying function, the monochrome printing function, and the scanner function) which employ no color ink, but "Not allowed" for two functions (the color copying function and the color printing function) which employ color ink. Therefore, during login, the user lock function permits User 1 to use the five functions which do not employ color ink but does not permit the user to use the two functions which employ color ink.

Figure 4:
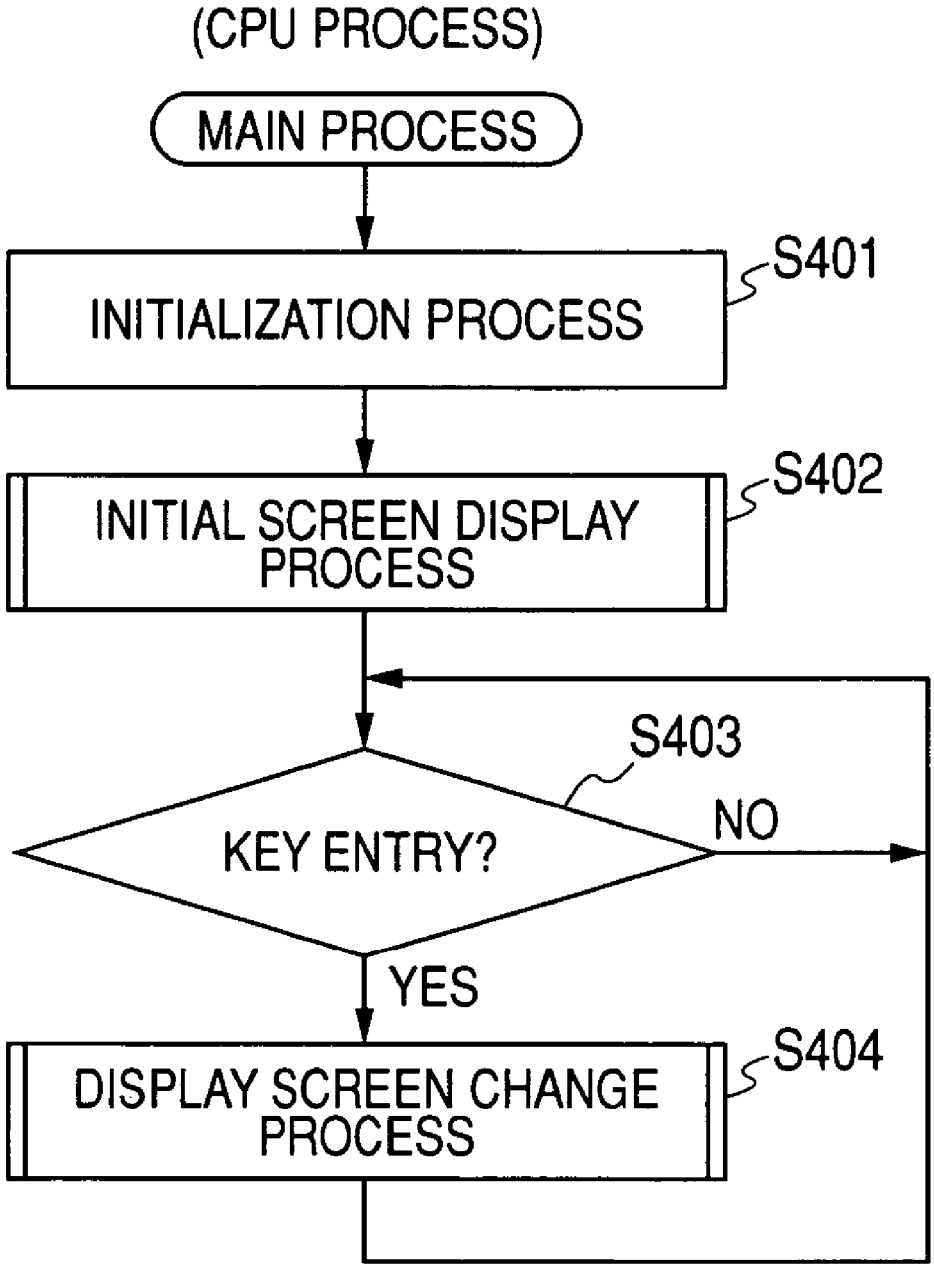
FIG. 4 shows a flowchart of a main process executed by the CPU of MFD 1.

Now, referring to FIG. 4, the operation performed in the MFD 1 configured as described above will be described. Note that FIG. 4 shows a flowchart of a main process executed by the CPU 12 of the MFD 1. The main process is started by turning ON the power supply to the MFD 1 and will be repeated until the power supply is turned OFF.

As shown in FIG. 4, the main process first performs an initialization process to initialize (turn OFF) the color ink depletion flag 16*a* and the K ink depletion flag 16*b* (s401), and then the system executes the initial screen display process to display an initial screen on the LCD 36 (S402). The system is also checks whether various keys such as the operation input keys 34 are pushed (S403). As a result of the check in Step S403, if no key is pushed (S403: No), then the system is returned to S403 and waits until a key is pushed.

On the other hand, as a result of the check in Step S403, if a key has been pushed (S403: Yes), the system performs a display screen change process for changing the screen on the LCD 36 to a screen corresponding to the type of the pushed key (S404). Then, after the display screen change process (S404) has been performed, the system is returned to Step S403 and again waits for the next key entry.

Note that the specific process performed in the initial screen display process (S402) will be described later referring to FIG. 5 and so on. In addition, the specific process performed in the display screen change process (S404) will be described later referring to FIG. 6 and so on.

Now, with reference to FIG. 5, description will be made for the initial screen display process (S402) to be performed in the above-described main process (see FIG. 4). FIG. 5 shows a flowchart of the initial screen display process (S402).

Figure 5:
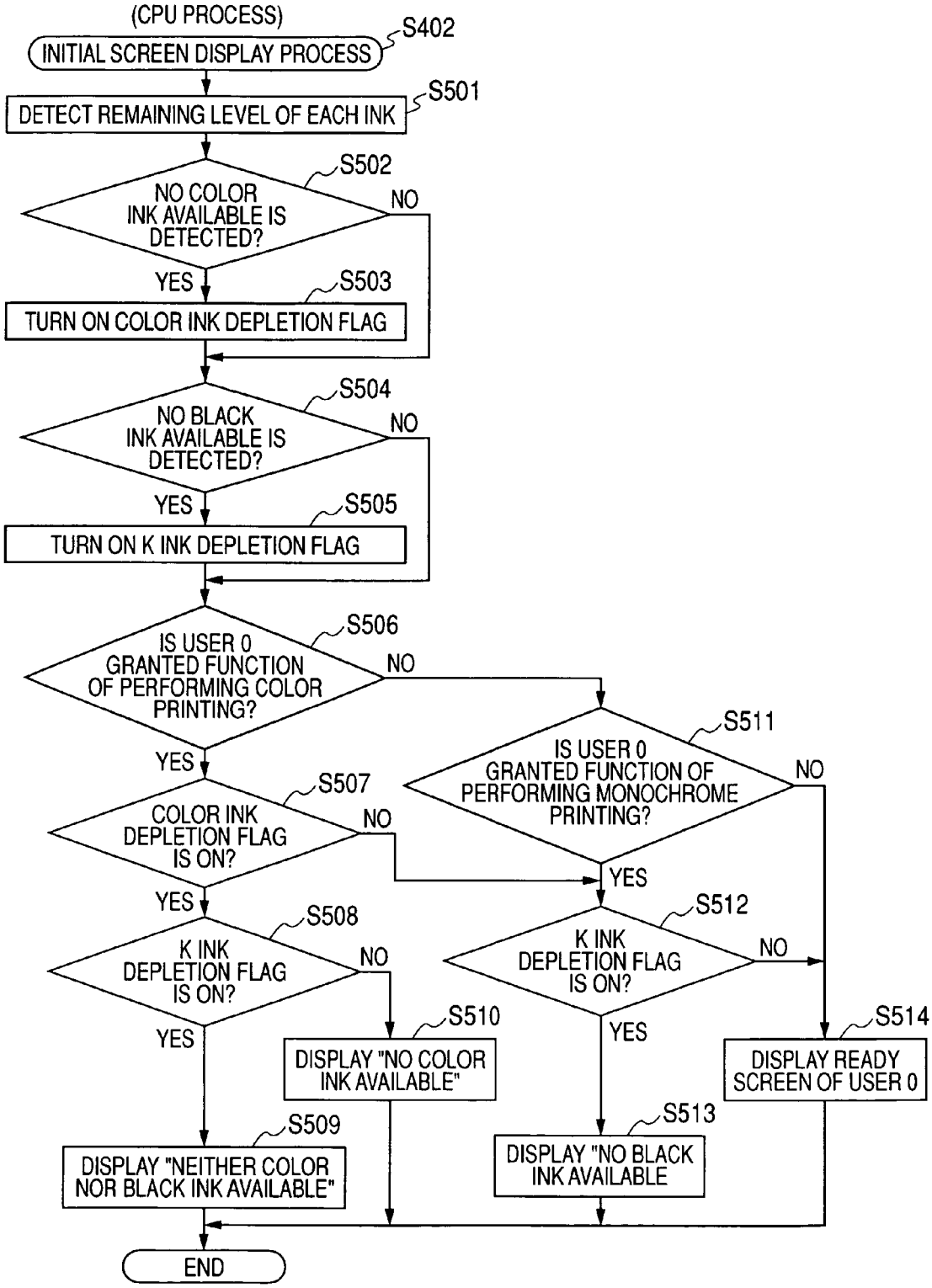
FIG. 5 shows a flowchart of an initial screen display process.

As shown in FIG. 5, the initial screen display process (s402) first detects the remaining level of each ink using the cyan ink level sensor 52, the magenta ink level sensor 54, the yellow ink level sensor 56, and the black ink level sensor 58 (S501). The system checks whether No color ink available is detected, that is, if at least one colorant of the cyan ink, the magenta ink, and the yellow ink is detected to have no remaining quantity (S502).

As a result of the check in Step S502, if No color ink available is detected (S502: Yes), the system turns ON the color ink depletion flag 16*a* (S503) and then proceeds to Step S504. On the other hand, as a result of the check in Step S502, if No color ink available is not detected (S502: No), then the system skips Step S503 and proceeds to Step S504.

In Step S503, the system checks whether No black ink available is detected (S503). As a result of the check in Step S503, if "No black ink available" has been detected (S503: Yes), then the system turns on "K depletion flag 16*b*" (S505), the system proceeds to Step S506. On the other hand, as a result of the check in Step S503, if "No black ink available" has not been detected (S503: No), then the system skips Step S505 and proceeds to Step S506.

In Step S506, referring to the user's usage restricting table 14*a*, the system checks whether the logged-in user has permission to use the function of performing color printing, that is, if at least one of the color copying function or the color printing function is permitted (S506). Note that the MFD 1 is adapted such that User 0 is automatically logged in when the power supply is turned ON. Thus, in Step S506, referring to the user's usage restricting table 14*a*, the system checks whether User 0 is permitted to use the function of performing color printing.

As a result of the check in Step S506, if User 0 is permitted to use the function of performing color printing (S506: Yes), the system checks whether the color ink depletion flag 16*a* is ON (S507). If the color ink depletion flag 16*a* is ON, that is, as a result of Step S501, if at least one colorant of the cyan ink, the magenta ink, and the yellow ink has been detected to have no remaining quantity (S507: Yes), then the system checks whether the K ink depletion flag 16*b* is ON (S508).

As a result of the check in Step S508, if the K ink depletion flag 16*b* is ON (S508: Yes), then the system displays an error indication "Neither color nor black ink available" on the LCD 36, it is indicated that no remaining color ink nor black ink is available (S509). The system then exits the initial screen display process (S402).

On the other hand, as a result of the check in Step S508, if the K ink depletion flag 16*b* is OFF (s508: No), then the system displays an error indication "No color ink available" on the LCD 36, indicating that some remaining quantity of black ink is available but no remaining quantity of color ink is available (S510). The system then exits the initial screen display process (S402).

In addition, as a result of the check in Step S507, if the color ink depletion flag 16*a* is OFF, that is, as a result of Step S501, if the remaining quantity of all the cyan ink, the magenta ink, and the yellow ink has been detected to be present (S507: No), then the system checks whether the K ink depletion flag 16*b* is ON (S512).

As a result of the check in Step S512, if the K ink depletion flag 16*b* is ON (S512; Yes), then the system displays an error indication "No black ink available" on the LCD 36, indicating that some remaining quantity of color ink is available and no remaining quantity of black ink is present (S513). The system then exits the initial screen display process (S402).

On the other hand, as a result of the check in Step S512, if the K ink depletion flag 16*b* is OFF (S512: No), then the system displays on the LCD 36 the ready screen that appears upon logging-in of the logged-in user or User 0 (S514). The system then exits the initial screen display process (S402).

Consequently, according to the initial screen display process (S402), if User 0 who has automatically been logged in upon turning ON the power supply has permission to use the function of performing color printing, the ready screen is displayed on the LCD 36 only when the remaining quantity of any of the color inks and the black ink necessary for performing color printing is available. When at least one of these inks of four colors has no remaining quantity (the remaining quantity shortage), a corresponding error indication is displayed on the LCD 36.

In addition, as a result of the check in Step S506, if User 0 is not permitted to use the function of performing color printing (S506: No), the system refers to the user's usage restricting table 14*a* to check whether User 0 is permitted to use the function of performing monochrome printing, that is, the user is permitted at least one of the monochrome copying function, the color printing function, and the facsimile receiving function (S511). As a result of the check in Step S511, if the function of performing monochrome printing is not granted to User 0 (S511: No), the system proceeds to Step S512.

Consequently, according to the initial screen display process (S402), if User 0 who has automatically been logged in upon turning ON the power supply is not permitted to use the function of performing color printing but permitted to use the function of performing monochrome printing, an error indication is then displayed on the LCD 36 only when black ink required to perform monochrome printing has no remaining quantity (the remaining quantity shortage). The ready screen is displayed on the LCD 36 only if some remaining quantity of black ink is available.

On the other hand, as a result of the check in Step S511, if User 0 is not permitted to use the function of performing monochrome printing, that is, if at least one of the scanner function and the facsimile transmission function, which perform neither color printing nor monochrome printing, is permitted (S511: No), the system proceeds to Step S514.

As such, according to the initial screen display process (S402), if User 0 who has automatically been logged in upon turning ON the power supply is permitted to use a function which is neither the function of performing color printing nor the function of performing monochrome printing, then the ready screen is displayed on the LCD 36 irrespective of the remaining quantity of inks of four colors.

Figure 6:
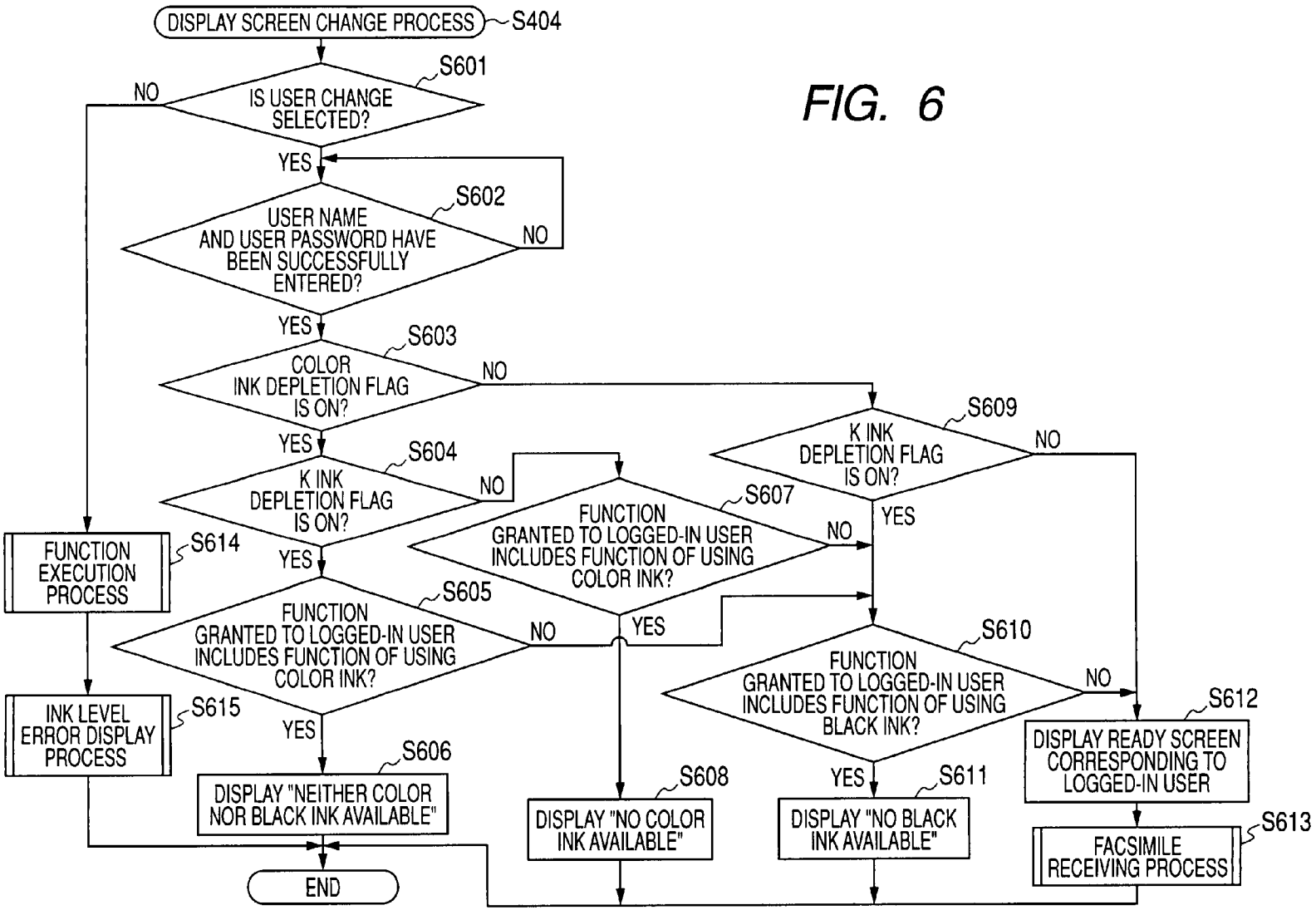
FIG. 6 shows a flowchart of a display screen change process.

Now, with reference to FIG. 6, description will be made for the display screen change process (s404) to be performed in the above-described main process (see FIG. 4). FIG. 6 shows a flowchart of the display screen change process (S404).

As shown in FIG. 6, in the display screen change process (S404), the system first checks whether the key checked in S403 (see FIG. 4) has been pushed to select the user change function, that is, if USER key (one of FUNCTION keys 71) has been pushed (S601).

As a result of the check in Step S601, if the user change function has been selected (S601: Yes), the system checks whether numerical keys (some of the operation input keys 34) have been pushed to successfully enter the username and the password that is pre-defined for each user (S602). If the username and the password have been successfully entered (S602: No), then the system is returned to S602 to wait until they are successfully entered.

On the other hand, as a result of the check in Step S602, if the username and the password have been successfully entered (S602: Yes), then the system checks whether the color ink depletion flag 16*a* is ON (S603). If the flag is ON (S603: Yes), then the system proceeds to S604 to check whether the K depletion flag 16*b* is ON (S604). If the flag is ON (S604: Yes), the system proceeds to S605.

In S605, the system checks whether the function granted to the logged-in user includes the function of using color ink. That is, the system reads the function of permitting use corresponding to the logged-in user from the user's usage restricting table 14*a* to check whether at least one of the color copying function and the color printing function is allowed to use.

As a result of the check in Step S605, if the function granted to the logged-in user includes the function of using color ink (S605: Yes), the system provides an error indication "Neither color nor black ink available" on the LCD 36 (S606). The system then exits the display screen change process (S404).

As a result of the check in Step S605, if the function granted to the logged-in user does not include the function of using color ink (S605: No), then the system proceeds to S610.

As a result of the check in Step S604, if the K depletion flag 16*b* is not ON (S604: No), then the system refers to the user's usage restricting table 14*a* to check whether the function granted to the logged-in user includes the function of using color ink, that is, the system checks whether it includes at least one of the color copying function or the color printing function (S607).

As a result of the check in Step S607, if the function granted to the logged-in user includes the function of using color ink (S607: Yes), then the system provides an error indication "No color ink available" on the LCD 36 (S608). The system then exits the display screen change process (S404).

On the other hand, as a result of the check in Step S607, if the function granted to the logged-in user does not include the function of using color ink (S608: No), then the system proceeds to S610.

As a result of the check in Step S603, if the color ink depletion flag 16*a* is not ON (S603: No), then the system proceeds to S609 to check whether the K depletion flag 16*b* is ON. As a result of the check in Step S609, if the K depletion flag 16*b* is ON, then the system proceeds to S610.

In S610, the system checks whether the function granted to the logged-in user includes the function of using black ink, that is, if it includes at least one of the monochrome copying function, the color copying function, the monochrome printing function, the color printing function, and the facsimile receiving function.

As a result of the check in Step S610, if the function granted to the logged-in user includes the function of using black ink (S610: Yes), then the system displays an error indication "No black ink available" (S611). The system then exits the display screen change process (S404).

On the other hand, as a result of the check in Step S610, the function granted to the logged-in user does not include the function of using black ink, that is, if only at least one of the scanner function and the facsimile transmission function which use no color ink nor black ink is permitted (S610: No), the system displays on the LCD 36 the ready screen which corresponds to the logged-in user upon logging-in (S612).

In addition, as a result of the check in Step S609, if the K toner depletion flag 16*b* is not ON, that is, if any ink has a remaining quantity equal to or greater than a predetermined level (S609: No), the system proceeds to Step S611. In S612, the system displays on the LCD 36 the ready screen which corresponds to the logged-in user upon logging-in, and then referring to FIG. 7, performs the facsimile receiving process to be described later (S613). After that, the system exits the display screen change process S404.

In addition, as a result of the check in Step S601, if the key checked in S403 (see FIG. 4) has been pushed to select other than the user change function (S601: No), then the system executes a function execution process for performing a process corresponding to the pushed key (S614). After that, the system performs the ink level error indication process for providing an error indication on the LCD 36 in accordance with the detection of the level of remaining ink and its detection result (S615), and then exits the display screen change process (S404). Note that description will be made later to the specific process performed in the function execution process (S614) with reference to FIG. 8, while the specific process performed in the ink level error display process (S615) will be described later referring to FIG. 9.

Consequently, according to the display screen change process (S404), when an error indication "Neither color nor black ink available" is displayed on the LCD 36 upon logging-in of a new user, the ready screen corresponding to the logged-in user is displayed on the LCD 36 if those functions granted to the new logged-in user do not include the function of using color ink or black ink.

However, if those functions granted to the new logged-in user include the function of using color ink or black ink, the error indication being displayed on the LCD 36 is allowed to remain thereon without being changed to the ready screen. For this reason, the continued error indication will cause the loss of a chance of instructing the execution of a function which can be executed following the display of the ready screen. Accordingly, such an error indication ("Neither color nor black ink available") would not be repeatedly displayed again and again when functions are executed, thereby alleviated is the frustration caused by an error indication displayed on the LCD 36 of the one-line display type, and thus the user's operating comfort is improved.

In addition, with the remaining quantity of color ink being equal to or less than a predetermine level and a prelogged-in user having no permission to perform the function of using color ink, the logging-in of the user may change him or her to such a user who can perform the function of using color ink (e.g., the user may be changed from User 1 to User 2 in FIG. 3). This causes the contents displayed on the LCD 36 to change from the ready screen being displayed to the indication of No color ink available. Thus, the logging-in allows the user, before performing any operation relating to the function of using color ink, to know that there is no color ink available. This allows for imposing a restriction on subsequently executed operations, thereby the user's operating comfort is improved.

According to the display screen change process (S404), an error indication "No black ink available" may be displayed on the LCD 36 upon logging-in of a new user. In this case, when those functions granted to the new logged-in user do not include the function of using black ink (the monochrome copying function, the color copying function, the monochrome printing function, the color printing function, and the facsimile receiving function), the system displays on the LCD 36 the ready screen corresponding to the logged-in user.

However, when those functions granted to the new logged-in user include the function of using black ink, the error indication being displayed on the LCD 36 is allowed to remain thereon without being changed to the ready screen. For this reason, the continued error indication will cause the loss of a chance of instructing the execution of a function which can be executed following the display of the ready screen. Accordingly, such an error indication ("No black ink available") would not be repeatedly displayed again and again when functions are executed, thereby alleviated is the frustration caused by an error indication displayed on the LCD 36 of the one-line display type, and thus the user's operating comfort is improved.

Now, with reference to FIG. 7, description will be made for the facsimile receiving process (S613) to be performed in the above-described display screen change process (see FIG. 6).

Figure 7:
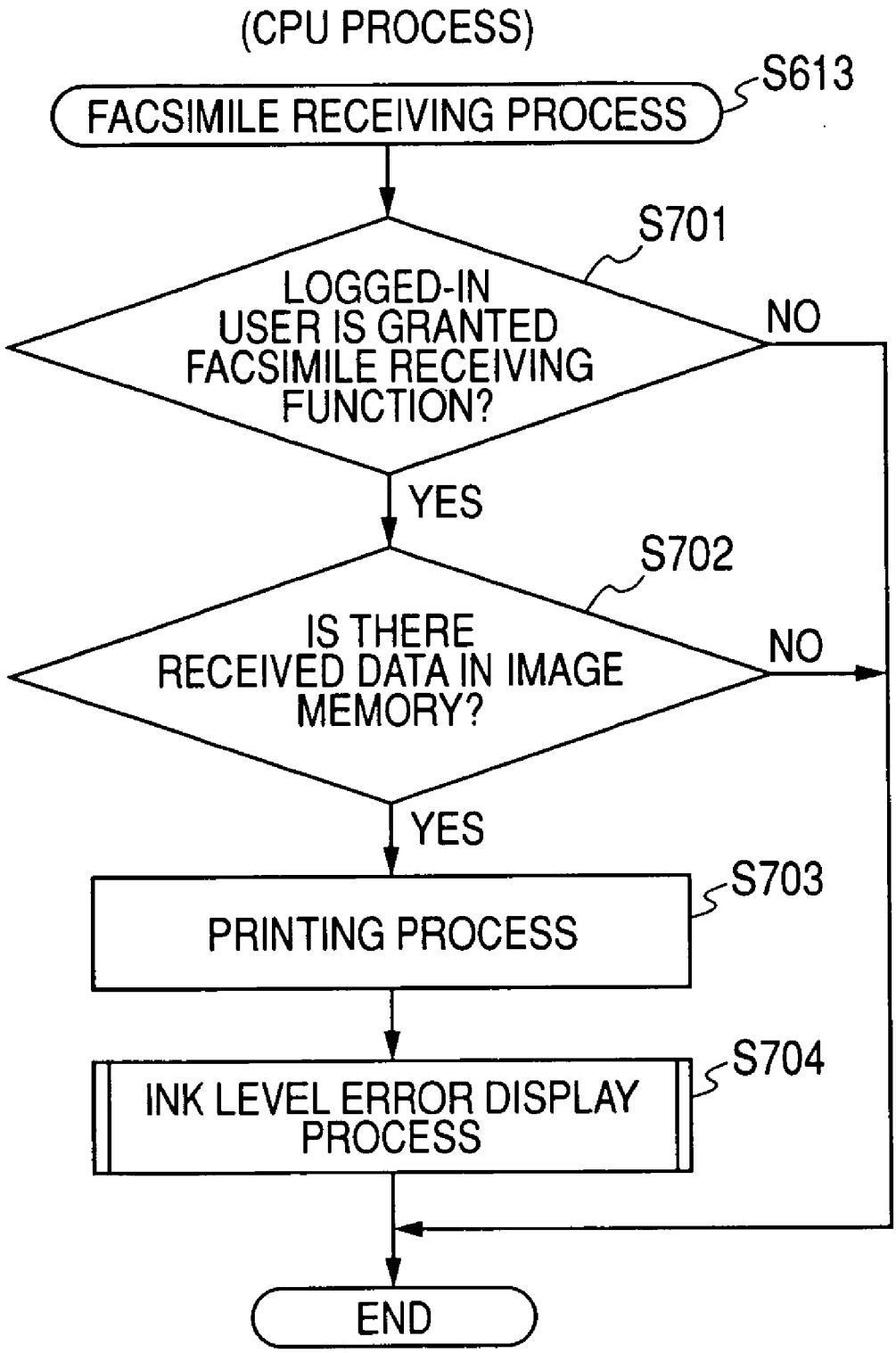
FIG. 7 shows a flowchart of a facsimile receiving process.

As shown in FIG. 7, the facsimile receiving process first refers to the user's usage restricting table 14*a* to check whether the logged-in user is permitted to perform the facsimile receiving function (S701).

As a result of the check in Step S701, the logged-in user is permitted to perform the facsimile receiving function (S701: Yes), then the system checks whether received data (received facsimile data) is available in the image memory 18 (S702). If received data is available (S702: Yes), the system performs a printing process for allowing the printer part 24 to print such received data on recording sheet (S703).

After performing the printing process (S704), the system performs the ink level error indication process to provide an error indication on the LCD 36 in accordance with the detection of the level of remaining ink and its detection result (S704). The system then exits the facsimile receiving process (S613). Note that the specific process performed in the ink level error display process (S704) will be described later referring to FIG. 9.

In addition, as a result of the check in Step S701, if the logged-in user is not permitted to perform the facsimile receiving function (S701: No), or as a result of the check in Step S702, if received data is not available in the image memory 18 (S702: No), the system then exits the facsimile receiving process (S613).

Accordingly, in the facsimile receiving process (S613), the level of remaining black ink may be equal to or greater than a predetermined level, the facsimile receiving function may be granted to the logged-in user, and received data may be available in the image memory. In this case, the logging-in of the user allows the facsimile receiving process to be automatically performed, thereby the user's operating comfort is improved. Furthermore, after performing the printing process, the system performs again the ink level error display process, thereby provided is an indication based on an accurate result of detecting the level of remaining ink.

Figure 8:
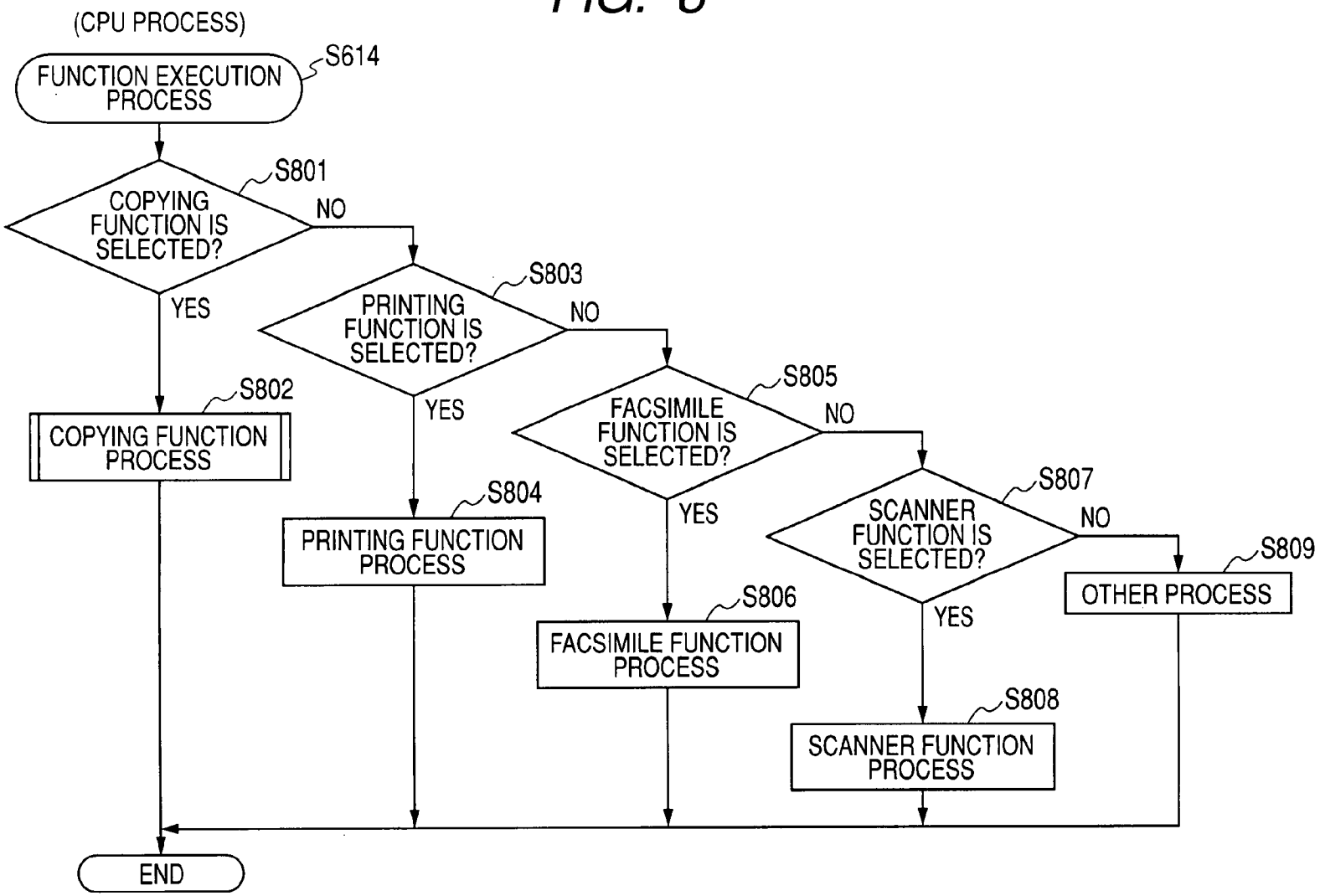
FIG. 8 shows a flowchart of a function process.

Now, with reference to FIG. 8, description will be made for the function execution process (S614) to be performed in the above-described display screen change process (see FIG. 6). FIG. 8 shows a flowchart of the function execution process (S614).

As shown in FIG. 8, the function execution process (S614) first checks whether the key checked in S403 (see FIG. 4) has been pushed to select the copying function, that is, if COPY key (one of FUNCTION keys 71) has been pushed (S801). If the copying function has been selected (S801: Yes), then the system performs the copying function process (S802), and exits the function execution process (S614).

The copying function process (S802) is to perform the copying process when the logged-in user is permitted to perform a copying function (the color copying function and/or the monochrome copying function) in the user's usage restricting table 14*a*.

On the other hand, as a result of the check in Step S801, if the copying function is not selected (S801: No), the system checks whether the printing function is to select, that is, whether the pushed key checked in S403 (see FIG. 4) is PRINT key (one of FUNCTION keys 71) (S803).

As a result of the check in Step S803, if "the printing function" is selected (S803: Yes), then the system performs the printing function process (S804), and exits the function execution process (S614). Note that the printing function process (S804) is to perform the printing process when the logged-in user is permitted to perform a printing function (the color printing function and/or the monochrome printing function) in the user's usage restricting table 14*a*.

In addition, as a result of the check in Step S803, if the printing function is not selected (S803: No), the system checks whether the facsimile function is to select, that is, if the pushed key checked in S403 (see FIG. 4) is FAX key (one of FUNCTION keys 71) (S805).

As a result of the check in Step S805, if the facsimile function is selected (S805: Yes), then the system performs the facsimile function process (S806), and exits the function execution process (S614). Note that the facsimile function process (S806) allows the printer part 24 to print received data stored in the image memory 18, if any, on recording sheet when the logged-in user is permitted to perform the facsimile receiving function in the user's usage restricting table 14*a*. After that, the system proceeds to a stand-by state waiting for the receiving of facsimile data. On the other hand, when the user is permitted to perform the facsimile transmission function, the system proceeds to a stand-by state waiting for the transmission of facsimile data.

In addition, as a result of the check in Step S805, if the facsimile function is not selected (S805; No), the system checks whether the scanner function is to select, that is, the pushed key checked in S403 (see FIG. 4) is SCAN key (one of FUNCTION keys 71) (S807).

As a result of the check in Step S807, if "the scanner function" is selected (S807: Yes), then the system performs the scanner function process (S808), and exits the function execution process (S614). Note that the scanner function process (S808) is to perform a scanner process when the logged-in user is permitted to perform the scanner function in the user's usage restricting table 14*a*.

On the other hand, as a result of the check in Step S807, if the scanner function is not selected (S805: No), the pushed key checked in S403 (see FIG. 4) is an operation input key 34 other than a FUNCTION key 71. Thus, the system performs another process corresponding to each operation input key 34 (S809), and then exits the function execution process (S804). The process to be performed in another process (S809) includes, for example, the process for cleaning the print head (not shown) of the printer part 24.

Figure 9:
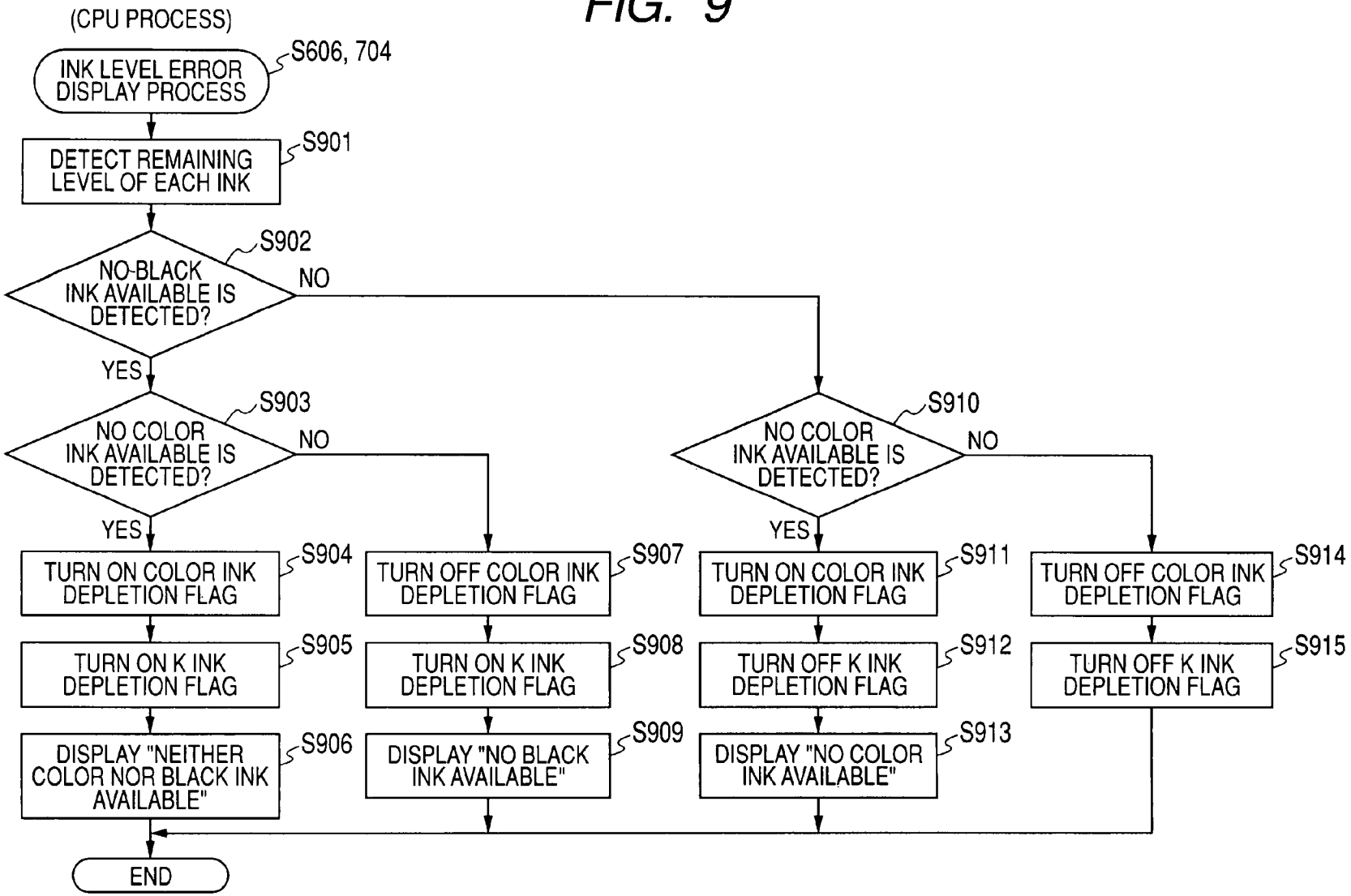
FIG. 9 shows a flowchart of an ink level error display process.

Next, with reference to FIG. 9, description will be made for the ink level error display process (S606) to be performed in the above-described display screen change process (see FIG. 6). FIG. 9 shows a flowchart of the ink level error display process (S606).

As shown in FIG. 9, the ink level error display process (S606) detects first the remaining level of each ink using the cyan ink level sensor 52, the magenta ink level sensor 54, the yellow ink level sensor 56, and the black ink level sensor 58 (S901) to check whether No black ink available is detected (S902). As a result of the check in Step S902, if No black ink available has been detected (S902: Yes), then the system checks whether No color ink available is detected, that is, if at least one colorant of the cyan ink, the magenta ink, and the yellow ink is detected to have no remaining quantity (S903).

As a result of the check in Step S903, if No color ink available is detected (S903: Yes), the system turns ON the color ink depletion flag 16*a* (S904) and turns on the K ink depletion flag 16*b* (S905), then provides on the LCD 36 an error indication "Neither color nor black ink available" which indicates that no remaining color ink nor black ink is available (S906). The system then exits the ink level error display process (S606).

On the other hand, as a result of the check in Step 903, if No color ink available is not detected (S903: No), then the system turns OFF the color ink depletion flag 16*a* (S907), turns ON the K ink depletion flag 16*b* (S908), displays on the LCD 36 an error indication "No black ink available" indicating that a remaining quantity of color ink is available but no remaining quantity of black ink is available (S909), and then exits the ink level error display process (S606).

In addition, as a result of the check in Step S902, if "No black ink available" is not detected (S902: No), the system checks whether No color ink available is detected (S910). If No color ink available is detected (S910: Yes), the system turns ON the color ink depletion flag 16*a* (S911), turns OFF the K ink depletion flag 16*b* (S912), displays on the LCD 36 an error indication "No color ink available" indicating that some remaining quantity of black ink is available but no remaining quantity of color ink is available (S913), and then exits the ink level error display process (S606).

In addition, as a result of the check in Step S910, if No color ink available is detected, that is, if some remaining quantity of both color ink and black ink is available (S910: No), then the system turns OFF the color ink depletion flag 16*a* (S914) and turns ON the K ink depletion flag 16*b* (S905). The system then exits the ink level error display process (S606).

Accordingly, in the ink level error display process (S606), when the remaining quantity of color ink or black ink is not available as a result of the function execution process (see FIG. 8) having been performed, the system displays a corresponding error indication on the LCD 36.

Note that the ink level error display process (S704) to be performed in the display screen change process (see FIG. 7)

when only color ink is not available is the same as the ink level error display process (S606) shown in FIG. 9.

In addition, when an ink cartridge is replaced, the same process as the ink level error display process (S606) shown in FIG. 9 is also performed. Note that in this case, if an error indication is provided on the LCD 36 when the remaining quantity of both color ink and black ink being available is detected, the system releases the error indication and thereafter exits the process.

Figure 10:
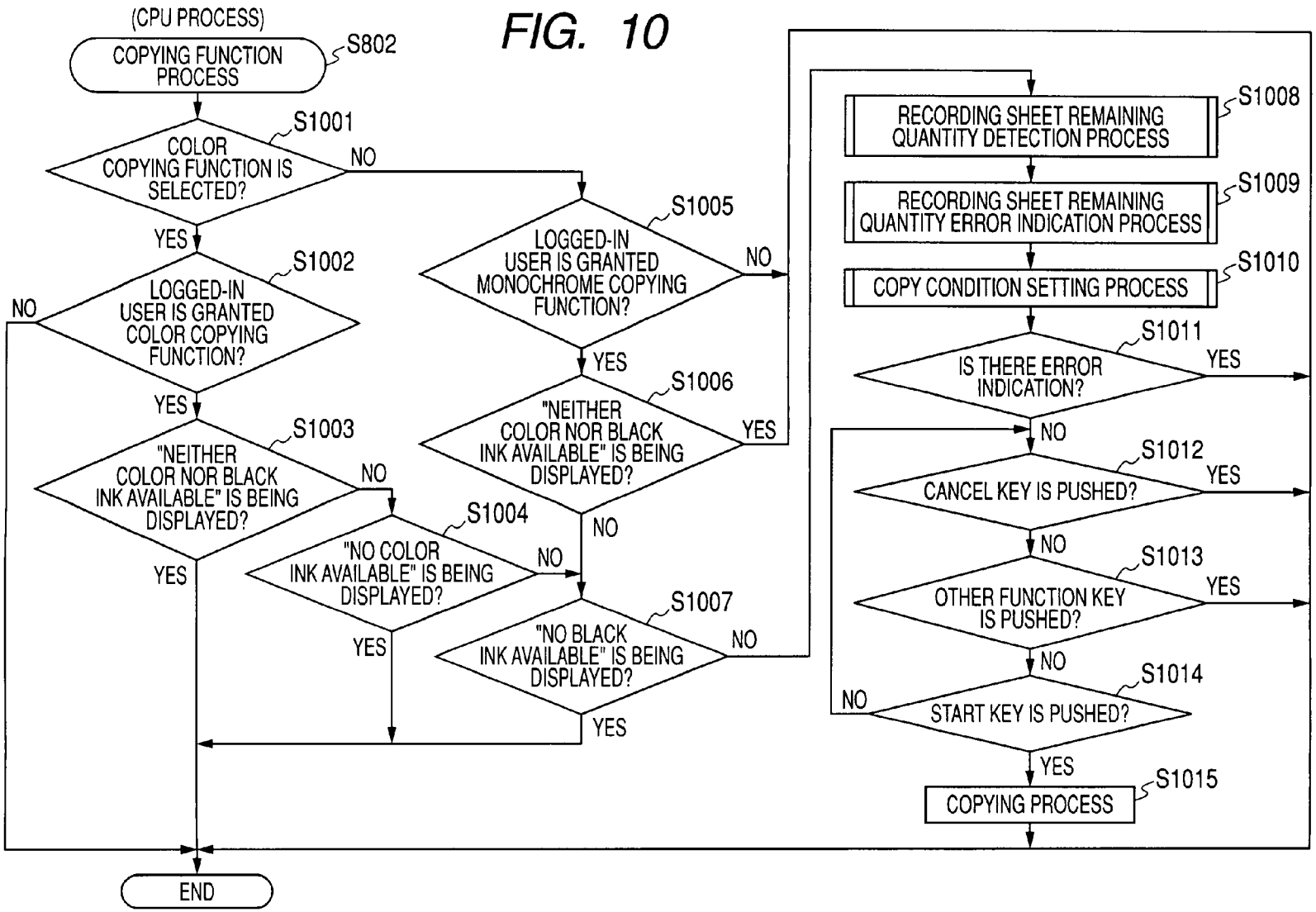
FIG. 10 shows a flowchart of a copying function process.

Now, with reference to FIG. 10, description will be made for the copying function process (S802) to be performed in the above-described function execution process (see FIG. 8). FIG. 10 shows a flowchart of the copying function process (S802).

As shown in FIG. 10, the copying function process (S802) first checks whether the color copying function is selected (S1001) If the color copying function is selected (S1001: Yes), the system refers to the user's usage restricting table 14*a* to check whether the logged-in user is permitted to perform the color copying function (S1002).

As a result of the check in Step S1002, if the logged-in user is not permitted to perform the color copying function (S1002: No), the system exits the copying function process (S802) because the user lock function inhibits the use of the color copying function.

On the other hand, as a result of the check in Step S1002, if the logged-in user is permitted to perform the color copying function (S1002: Yes), then the system checks whether an error indication "Neither color nor black ink available" is being displayed on the LCD 36 (S1003).

As a result of the check in Step S1003, if an error indication "Neither color nor black ink available" is displayed on the LCD 36 (s1003: Yes), the system immediately exits the copying function process (S802).

On the other hand, as a result of the check in Step S1003, if an error indication "Neither color nor black ink available" is not displayed on the LCD 36 (S1003: No), the system checks whether an error indication "No color ink available" is being displayed on the LCD 36 (S1004).

As a result of the check in Step S1004, if an error indication "No color ink available" is displayed on the LCD 36 (S1004: Yes), the system immediately exits the copying function process (S802).

In addition, as a result of the check in Step S1003, if an error indication "No color ink available" is not displayed on the LCD 36 (S1004; No), then the system checks whether an error indication "No black ink available" is being displayed on the LCD 36 (S1007).

As a result of the check in Step S1006, if an error indication "No black ink available" is displayed on the LCD 36 (S1007: Yes), the system immediately exits the copying function process (S802).

Accordingly, in the copying function process (S802), a user who is permitted to perform the color copying function may try to perform the color copying function. Even in this case, when at least one of the inks of the four colors required to perform the color copying function has no remaining quantity (the remaining quantity shortage), the system exits the copying function process (S802) without the error indication being changed to the copy ready screen.

Here, consider a multi-function peripheral device in which the system displays the copy ready screen even when at least one of the inks of the four colors required to perform the color copying function has no remaining quantity (the remaining quantity shortage). When the system displays the copy ready screen with the shortage of a supply (the remaining level shortage of a consumable), the START button may be subsequently pushed to display an error indication again, thereby the user's operating comfort is compromised. However, in the MFD 1, the continued error indication will cause the loss of a chance of instructing the execution of the color copying function which can be executed following the display of the copy ready screen. Accordingly, such an error indication on the level of remaining ink would not be repeatedly displayed again and again when functions are executed, thereby alleviated is the frustration caused by an error indication displayed on the LCD 36 of the one-line display type, and thus the user's operating comfort is improved.

In addition, as a result of the check in Step S1001, if not the color copying function but the monochrome copying function is selected (S1001: No), the system refers to the user's usage restricting table 14*a* to check whether the logged-in user is permitted to perform the monochrome copying function (S1005).

As a result of the check in Step S1005, if the logged-in user is not permitted to perform the monochrome copying function (S1005: No), the system exits the copying function process (S802) because the user lock function inhibits the use of the monochrome copying function.

On the other hand, as a result of the check in Step S1005, the logged-in user is permitted to perform the monochrome copying function (S1005: Yes), the system checks whether an error indication "Neither color nor black ink available" is being displayed on the LCD 36 (S1006).

As a result of the check in Step S1006, if an error indication "Neither color nor black ink available" is displayed on the LCD 36 (S1006: Yes), the system immediately exits the copying function process (S802).

On the other hand, as a result of the check in Step S1006, if an error indication "Neither color nor black ink available" is not displayed on the LCD 36 (S1006: No), the system checks whether an error indication "No black ink available" is being displayed on the LCD 36 (S1007).

As a result of the check in Step S1007, if an error indication "No black ink available" is displayed on the LCD 36 (S1006; Yes), the system immediately exits the copying function process (S802).

Accordingly, in the copying function process (S802), the user who is permitted to perform the monochrome copying function may try to perform monochrome copying. Even in this case, when no remaining quantity of black ink required to perform the monochrome copying function is available (the remaining quantity shortage), the system exits the copying function process (S802) without displaying the copy ready screen on the LCD 36.

Here, consider a multi-function peripheral device in which the system displays the copy ready screen even when black ink required to perform the monochrome copying function has no remaining quantity (the remaining quantity shortage). When the system displays the copy ready screen with the shortage of a supply (the remaining level shortage of a consumable), the START button may be subsequently pushed to display an error indication again, thereby the user's operating comfort is compromised. However, in the MFD 1, the continued error indication will cause the loss of a chance of instructing the execution of the monochrome copying function which can be executed following the display of the copy ready screen. Accordingly, an error indication on the level of remaining ink would not be repeatedly displayed again and again, thereby alleviated is the frustration caused by an error indication displayed on the LCD 36 of the one-line display type, and thus the user's operating comfort is improved.

On the other hand, as a result of the check in Step S1007, if an error indication "No black ink available" is not displayed on the LCD 36, that is, if any error indications are present on the LCD 36 (S1007: No), then the system performs a recording sheet remaining quantity detection process for detecting the remaining quantity of recording sheet (S1008). Based on the results of the recording sheet remaining quantity detection process (S1008), the system performs a recording sheet remaining quantity error indication process for displaying an error indication on the LCD 36 in the presence of an error (S1009), and performs a copy condition setting process for providing image quality settings or the like (S1010).

Note that description will be made later to the specific process of the recording sheet remaining quantity detection process (S1008) with reference to FIG. 11. The specific process of the recording sheet remaining quantity error indication process (S1009) will be described later with reference to FIG. 12, while the specific process of the copy condition setting process (S1010) will be described later referring to FIG. 13.

After performing the copy condition setting process (S1010), the system checks whether an error indication on the remaining quantity of recording sheet is present (S1011). If such an error indication is present (S1011: No), the system exits the copying function process (S802).

On the other hand, as a result of the check in Step S1011, if no error indication on the remaining quantity of recording sheet is present (S1011: No), the system checks whether CANCEL key (one of operation input keys 37) is pushed (S1012).

As a result of the check in Step S1012, if the CANCEL key has not been pushed (S1012: No), the system checks for a FUNCTION key 71 (another FUNCTION key 71) other than COPY key for instructing the execution of the copying function (S1013).

As a result of the check in Step S1013, if another FUNCTION key 71 has not been pushed (S1013: No), the system checks whether the START key (one of the operation input keys 37) has been pushed (S1014). Here, if the START key has not been pushed (S1013: No), the system proceeds to Step S1012.

On the other hand, as a result of the check in Step S1014, if the START key has been pushed (S1014: Yes), then the system performs the copying process with the function checked in S1001 (the color copying function or the monochrome copying function) (S1015) and exits the copying function process (S802). Note that the copying process (S1015) allows the printer part 24 to print on recording sheet the image data of the original document acquired by the scanner part 22.

In addition, as a result of the check in Step S1012, if the CANCEL key is pushed (S1012: Yes), the system exits the copying function process (S802) and cancels the execution of the copying function. In addition, as a result of the check in Step S1013, if another FUNCTION key 71 is determined to have been pushed (S1013; Yes), the system exits the copying function process (S802) in order to perform the function corresponding to the pushed FUNCTION key 71.

Note that the flowchart of the printing function process (S804) to be performed in the function execution process (see FIG. 8) is not herein shown; however, the same process as the copying function process (S802) described referring to FIG. 8 is carried out in this printing function process (S804). Accordingly, in the printing function process (S804), the user who is permitted to perform the color printing function or the monochrome printing function may also try to execute the function using a supply (consumable) targeted for an error indication while the error indication on the level of remaining ink is being displayed. Even in this case, the system exits the printing function process (S804) without changing the error indication to the ready screen.

Similarly, in the facsimile function process (S806), the user who is permitted to perform the facsimile receiving function may also try to execute the facsimile receiving function using a supply (consumable) targeted for an error indication, that is, black ink while such an error indication due to no remaining quantity of black ink is being displayed. Even in this case, the error indication cannot be changed to the print ready screen.

Accordingly, with the shortage of a supply in these function processes (S804, S806), the continued error indication will also cause the loss of a chance of instructing the execution of a function. As a result, an error indication would not be repeatedly displayed again and again, thereby alleviated is the frustration caused by an error indication displayed on the LCD 36 of the one-line display type, and thus the user's operating comfort is improved.

Now, with reference to FIG. 11, description will be made for the recording sheet remaining quantity detection process (S1008) to be performed in the above-described copying function process (S802). FIG. 11 shows the flowchart of the recording sheet remaining quantity detection process (S1008).

Figure 11:
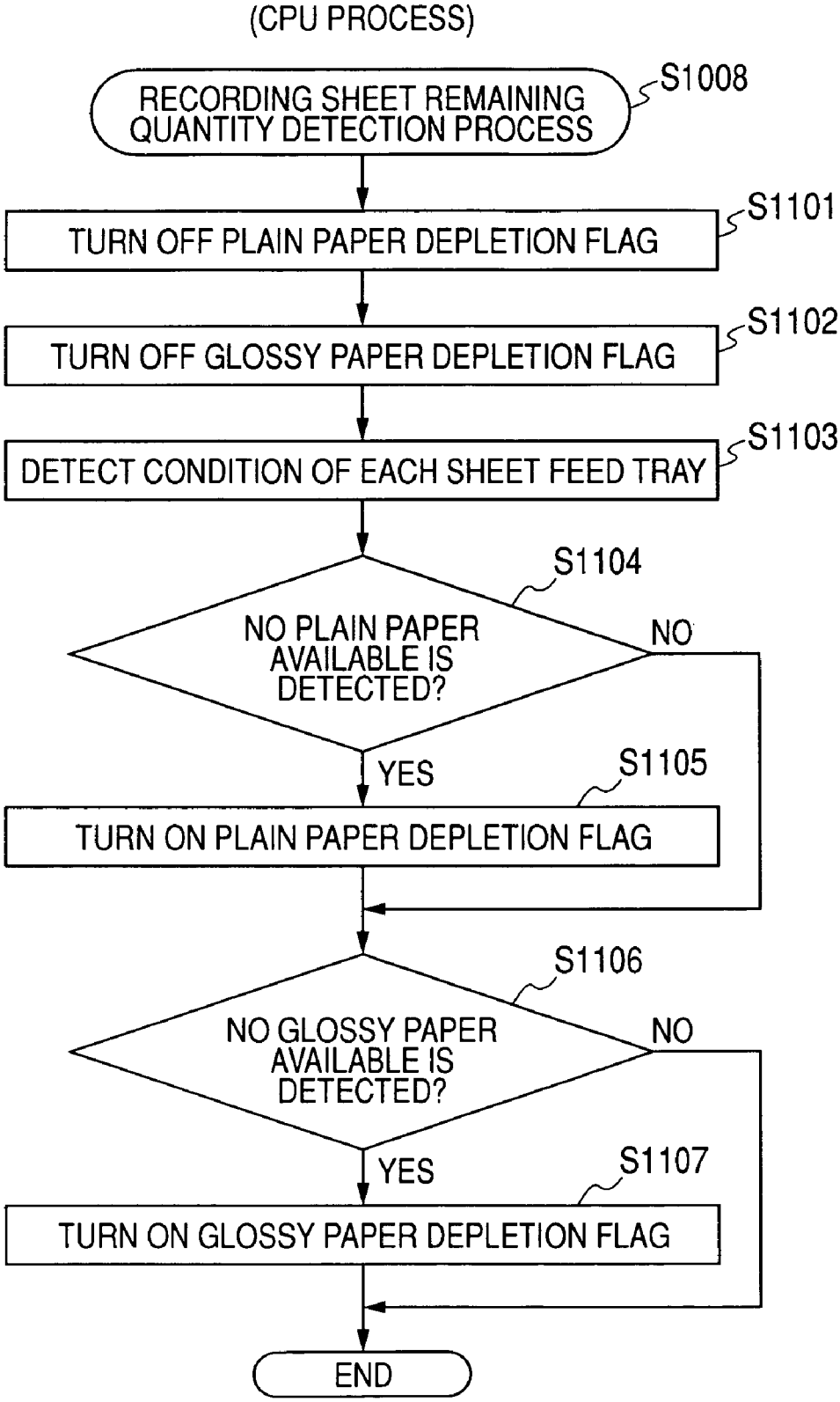
FIG. 11 shows a flowchart of a remaining sheet quantity detection process.

As shown in FIG. 11, the recording sheet remaining quantity detection process (S1008) first turns OFF the plain paper depletion flag 16*c* (S1101) and turns OFF the glossy paper depletion flag 16*d* (S1102).

After performing the process of S1102, the system detects the condition of each sheet feed tray (not shown) using the plain paper quantity sensor 62 and the glossy paper quantity sensor 64 (S1103) to check whether "No plain paper available" is detected (S1104).

As a result of the check in Step S1104, if "No plain paper available" has been detected (S1104: Yes), then the system turns ON "the plain paper depletion flag 16*c*" (S1105) and proceeds to Step S1106. On the other hand, as a result of the check in Step S1104, if "No plain paper available" has not been detected (S1104: No), then the system skips Step S1105 and proceeds to Step S1106.

In Step S1106, the system checks whether "No glossy paper available" is detected (S1106). As a result of the check in Step S1106, if "No glossy paper available" has been detected (S1106: Yes), then the system turns ON "the glossy paper depletion flag 16*d*" (S1107) and exits the recording sheet remaining quantity detection process (S1008). On the other hand, as a result of the check in Step S1106, if "No glossy paper available" has not been detected (S1106: No), then the system skips Step S1107 and exits the recording sheet remaining quantity detection process (S1008).

Figure 12:
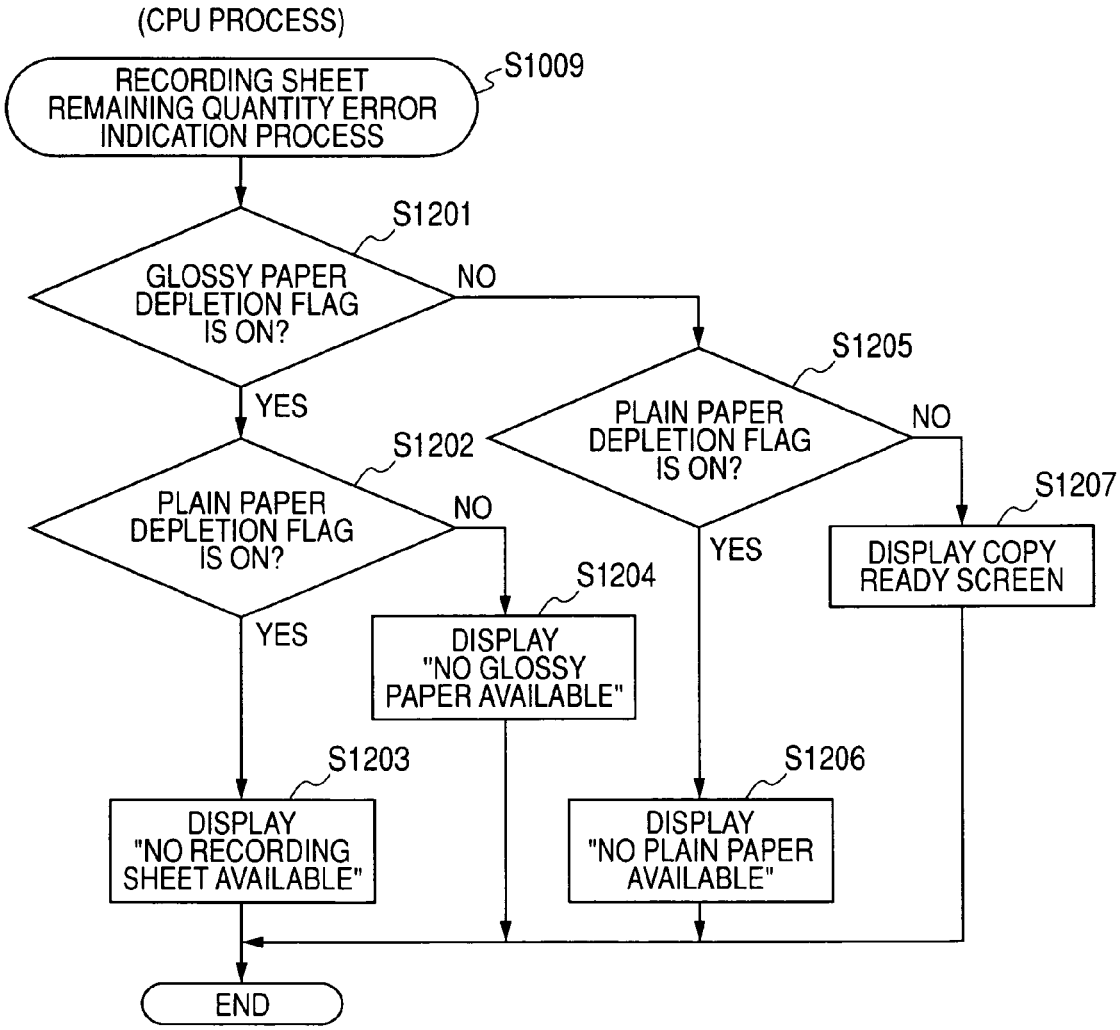
FIG. 12 shows a flowchart of a remaining sheet quantity error indication process.

Now, with reference to FIG. 12, description will be made for the recording sheet remaining quantity error indication process (S1009) to be performed in the above-described copying function process (S802). FIG. 12 shows a flowchart of the recording sheet remaining quantity error indication process (S1009).

As shown in FIG. 12, the recording sheet remaining quantity error indication process (S1009) first checks whether the glossy paper depletion flag 16*d* is ON (S1201). If the glossy paper depletion flag 16*d* is ON (S1201: Yes), then the system checks whether the plain paper depletion flag 16*c* is ON (S1202).

As a result of the check in Step S1202, if the plain paper depletion flag 16*c* is ON (S1202: Yes), then the system displays on the LCD 36 an error indication "No recording sheet available" indicating that no remaining quantity of both plain paper and glossy paper is available (S1203). The system then exits the recording sheet remaining quantity error indication process (S1009).

On the other hand, as a result of the check in Step S1202, if the plain paper depletion flag 16*c* is OFF (S1202: No), then the system displays on the LCD 36 an error indication "No glossy paper available" indicating that some remaining quantity of plain paper is available but no remaining quantity of glossy paper is available (S1204). The system then exits the recording sheet remaining quantity error indication process (S1009).

In addition, as a result of the check in Step S1201, if the glossy paper depletion flag 16*d* is OFF (S1201: No), then the system checks whether the plain paper depletion flag 16*c* is ON (S1205). As a result of the check in Step S1205, if the plain paper flag 16*c* is ON (S1205: Yes), then the system displays on the LCD 36 an error indication "No plain paper available" indicating that some remaining quantity of glossy paper is available but no remaining quantity of plain paper is available (S1206). The system then exits the recording sheet remaining quantity error indication process (S1009).

On the other hand, as a result of the check in Step S1205, if the plain paper depletion flag 16*c* is OFF (S1205: No), then the system displays the copy ready screen on the LCD 36 because both plain paper and glossy paper are available (S1207) and exits the recording sheet remaining quantity error indication process (S1009).

Figure 13:
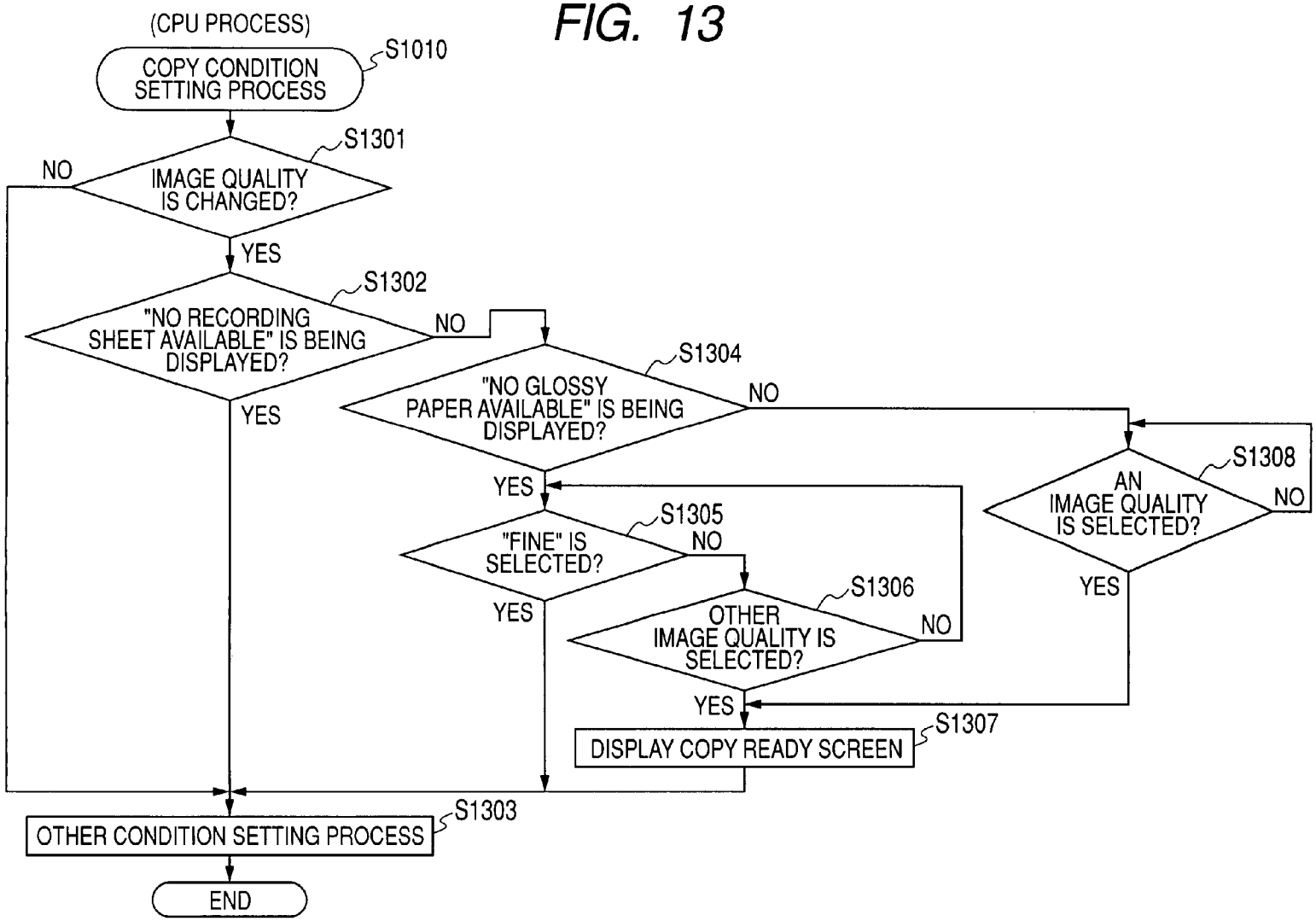
FIG. 13 shows a flowchart of a copy condition setting process.

Now, with reference to FIG. 13, description will be made for the copy condition setting process (S1010) to be performed in the above-described copying function process (s802). FIG. 13 shows a flowchart of the copy condition setting process (S1010).

As shown in FIG. 13, the copy condition setting process (S1010) first checks whether IMAGE QUALITY key 73 is pushed to instruct a change to the image quality (S1301). If no instruction is provided to change the image quality (S1301: No), then the system performs, as required, another condition setting process for setting a condition other than the image quality (S1303). Then, the system exits the copy condition setting process (S1010).

On the other hand, as a result of the check in Step S1301, if an instruction has been provided to change the image quality (S1301: Yes), then the system checks whether an error indication "No recording sheet available" is being displayed on the LCD 36 (S1302).

As a result of the check in Step S1302, if an error indication "No recording sheet available" is displayed on the LCD 36 (S1302: Yes), the system proceeds to another condition setting process (S1303). Note that in the other condition setting process (S1303), the system is intended to exit another condition setting process (S1303) when an error indication "No recording sheet available" is displayed on the LCD 36. Thus, the system executes Step S1012 in the copying function process (see FIG. 10) with an error indication "No recording sheet available" displayed on the LCD 36.

Accordingly, when the recording sheet required to perform the copying function (the color copying function or the monochrome copying function) has no remaining quantity (the remaining quantity shortage), the system is inhibited to change the error indication to the copy ready screen. For this reason, the continued error indication will cause the loss of a chance of instructing the execution of the copying function with the shortage of a supply, and thus an error indication on the remaining quantity of recording sheet would not be repeatedly displayed again and again. This alleviates the frustration caused by an error indication displayed on the LCD 36 of the one-line display type, and thus the user's operating comfort is improved.

On the other hand, as a result of the check in Step S1302, if an error indication "No recording sheet available" is not displayed on the LCD 36 (S1302: No), then the system checks whether an error indication "No glossy paper available" is being displayed on the LCD 36 (S1304).

As a result of the check in Step S1304, if an error indication "No glossy paper available" is displayed on the LCD 36 (S1304: Yes), then the system checks whether IMAGE QUALITY key 73 is pushed to display "Fine" on the LCD 36 and the RETURN key (one of the operation input keys 34) is pushed to select "Fine" (S1305). As a result of the check in Step S1305, if "Fine" is selected (S1305: Yes), the system proceeds to Step S1303.

On the other hand, as a result of the check in Step S1305, if "Fine" is not selected (S1305: No), the system checks whether another image quality ("Text" or "Auto") is selected (S1306). As a result of the check in Step S1306, another image quality is not selected either (S1306: No), the system is returned to Step S1305.

Here, as a result of the check in Step S1306, if another image quality ("Text" or "Auto") is selected (S1306: Yes), then the system sets the selected image quality, and displays the copy ready screen on the LCD 36 (S1307). After that, the system proceeds to Step S1303.

Accordingly, in the copy condition setting process, an error indication "No glossy paper available" may be displayed on the LCD 36 indicating that no glossy paper required for high image quality copying is available in the sheet feed tray (not shown). In this case, even when the user tries to change the image quality to high image quality ("Fine"), the error indication being displayed on the LCD 36 is allowed to remain thereon without being changed to the copy ready screen. For this reason, such an error indication would not be repeatedly displayed again and again, thereby alleviated is the frustration caused by an error indication displayed on the LCD 36 of the one-line display type, and thus the user's operating comfort is improved. On the other hand, when high image quality is selected, it is ensured to perform high image quality copying using glossy paper, thereby the level of quality is reliably kept.

As a result of the check in Step S1304, if an error indication "No glossy paper available" is not displayed on the LCD 36, that is, if an error indication "No plain paper available" is being displayed or no error indication is present (S1304: No), then the system checks to which one of "Fine," "Text," or "Auto" the image quality is set (S1308). If no image quality selection is found (S1308: No), then the system is returned to Step S1308 and waits until an image quality is selected.

On the other hand, as a result of the check in Step S1308, an image quality is selected (S1308: Yes), the system sets the selected image quality and displays the copy ready screen on the LCD 36 (S1307). Then, the system proceeds to Step S1303.

In the above aspects, the copying function process has been described in detail. However, the printing function process is also performed in the same manner with the copying replaced with printing in each step of FIG. 10 through FIG. 13.

As described above, according to the MFD 1, a supply (consumable), which needs to be supplied as appropriate, may be detected to have no remaining quantity, with an error indication provided on the LCD 36 in accordance with such a detection. The user may select (specify) a predetermined function in this situation. Even in this case, when the supply required to execute the selected (specified) function is targeted for an error indication, it is inhibited to change the error indication being displayed to the ready screen of the corresponding function.

For this reason, display switching is inhibited when it is determined that the user may possibly execute a function that cannot be used due to the remaining level shortage of a consumable, thereby caused is the loss of a chance of instructing the execution of the function that cannot be used due to the remaining level shortage of the supply. Therefore, this would prevent an error indication from being provided when such a function is instructed to execute, thereby alleviated is the frustration caused by an error indication. On the other hand, when a warning indication is required, it is ensured the warning indication is displayed. As a result, it is possible to improve the user's operating comfort, and as well improve the user's feeling of operating ease and operability.

The present invention is not limited to the above-described aspects. Various modifications and changes may be made.

For example, in the above aspects, the copy condition setting process (see FIG. 13) inhibits the error indication from being switched to the ready screen in response to a change made to the image quality. However, the inhibition of the switching of the indication resulting from a change to the set value is not limited to the image quality. For example, consider a case where the zooming ratio is changed while an error indication is being displayed indicating that no remaining quantity of recording sheet of a predetermined size is available. In this case, the system may inhibit the indication from being switched to the ready screen when the recording sheet of a size on which a zoomed image can be printed is targeted for an error indication.

Furthermore, in the copy condition setting process (see FIG. 13), the switching of the indication is inhibited when "Fine" is selected as the image quality with an error indication "No glossy paper available" displayed on the LCD 36. However, the system may not display a screen which allows "Fine" to be selected as the image quality with an error indication "No glossy paper available" displayed on the LCD 36.

Furthermore, in the above aspects, an optical sensor is used as the cyan ink level sensor 52, the magenta ink level sensor 54, the yellow ink level sensor 56, and the black ink level sensor 58. However, any alternative sensor may also be employed as long as it can serve to detect the level of remaining ink. Similarly, in the above aspects, a limit type sensor is used as the plain paper quantity sensor 62 and the glossy paper quantity sensor 64. However, any alternative sensor may also be employed as long as it can serve to detect the remaining quantity of recording sheet in the sheet feed tray.

Furthermore, a consumable may not only be ink and glossy paper but also a consumable such as toner and ink ribbon. Furthermore, in the above aspects, all functions are permitted to be used. However, without being limited thereto, these settings may be provided by the user.

What is claimed is:

1. An image forming apparatus including a plurality of functions that include a function of executing an operation involving use of a consumable, the image forming apparatus comprising:

a display;

a selecting unit that selects one function to be executed from the plurality of functions;

a detector that detects a remaining level of the consumable; and a controller that is operable to:

switch contents displayed on the display to information corresponding to the one function when the one function is selected by the selecting unit;

instruct execution of an operation corresponding to the information displayed on the display as a result of the switching the contents;

display a warning indication on the display when the remaining level of the consumable is detected to be equal to or less than a predetermined level; and inhibit the switching of the contents displayed on the display, inhibit displaying of information other than the warning indication, and continuously display the warning indication on the display when the warning indication has been displayed for a predetermined time and the one function selected by the selecting unit is determined to be the function of executing the operation involving use of the consumable while the warning indication is displayed on the display, wherein the controller switches the warning indication displayed on the display with the information other than the warning indication when the warning indication has been displayed for a predetermined time and the one function selected by the selecting unit is determined not to be the function of executing the operation involving use of the consumable while the warning indication is displayed on the display.

2. The image forming apparatus according to claim 1, further comprising:

a storage that stores a plurality of pieces of identified information, each piece of the identified information corresponding to a function permitted to be used by a user from among the plurality of functions, wherein the one function selected by the selecting unit is a function being set by selecting one of the plurality of pieces of identified information stored in the storage, and wherein, when the function of executing the operation involving use of the consumable is included in the function permitted to be used by the user and corresponded to the identified information selected by the selecting unit, the controller determines that the one function selected by the selecting unit is the function of executing the operation involving use of the consumable.

3. The image forming apparatus according to claim 2, wherein, in a state where the one of the plurality of pieces of identified information being set, when the selecting unit selects a function other than a function of setting the identified information while a warning indication is being displayed on the display, the controller determines whether the selected one function is the function of executing the operation involving use of the consumable.

4. The image forming apparatus according to claim 1, wherein the controller is further operable to change a set value contained in the information corresponding to the one function selected by the selecting unit, wherein, when the set value is changed, the controller switches the contents displayed on the display to information corresponding to the changed set value, and wherein the controller inhibits the switching the contents displayed on the display when execution of the one function selected by the selecting unit in the changed set value involves use of the consumable.

5. The image forming apparatus according to claim 1, further comprising:

a plurality of keys corresponding to the plurality of functions, wherein the selecting unit selects a function that corresponds to a key operated by a user, wherein, in a state where any one of the function being selected while a warning indication is being displayed on the display, the controller determines whether the selected function is the function of executing the operation involving use of the consumable, wherein the controller inhibits the switching the contents displayed on the display when the selected function is determined to be the function of executing the operation involving use of the consumable, and wherein the controller switches the contents displayed on the display when the selected function is determined not to be the function of executing the operation involving use of the consumable.

6. The image forming apparatus according to claim 1, wherein the plurality of functions includes a scanner function and a print function, and wherein when the scanner function is selected the warning indication is switched and when the print function is selected, the warning indication is not switched.

7. A method for controlling an image forming apparatus, the image forming apparatus including a plurality of functions including a function of executing an operation involving use of a consumable, the method comprising:

selecting one function to be executed from the plurality of functions by a selecting unit;

switching contents displayed on a display to information corresponding to the one function when the one function is selected;

instructing execution of an operation corresponding to the information displayed on the display as a result of the switching the contents;

detecting a remaining level of the consumable; displaying a warding indication on the display when the remaining level of the consumable is detected to be equal to or less than a predetermined level;

inhibiting the switching of the contents displayed on the display, inhibiting displaying of information other than the warning indication, and continuously displaying the warning indication on the display when the warning indication has been displayed for a predetermined time and the one function selected by the selecting unit is determined to be the function of executing the operation involving use of the consumable while the warning indication is displayed on the display; and switching the warning indication displayed on the display with the information other than the warning indication when the warning indication has been displayed for a predetermined time and the one function selected by the selecting unit is determined not to be the function of executing the operation involving use of the consumable while the warning indication is displayed on the display.

8. The method for controlling an image forming apparatus according to claim 7, further comprising:

storing a plurality of pieces of identified information, each piece of the identified information corresponding to a function permitted to be used by a user from among the plurality of functions, wherein the one function selected by the selecting unit is a function being set by selecting one of the plurality of pieces of identified information stored in the storage, and wherein, when the function of executing the operation involving use of the consumable is included in the function permitted to be used by the user and corresponded to the identified information selected by the selecting unit, the one function selected by the selecting unit is determined to be the function of executing the operation involving use of the consumable.

9. The method for controlling an image forming apparatus according to claim 8, wherein, in a state where the one of the plurality of pieces of identified information being set, when the selecting unit selects a function other than a function of setting the identified information while a warning indication is being displayed on the display by the warning indication provision means, a determination is made as to whether the selected one function is the function of executing the operation involving use of the consumable.

10. The method for controlling an image forming apparatus according to claim 7, further comprising:

changing a set value contained in the information corresponding to the one function selected by the selecting unit, wherein, when the set value is changed, the contents displayed on the display is changed to information corresponding to the changed set value, and wherein the switching the contents displayed on the display is inhibited when execution of the one function selected by the selecting unit in the changed set value involves use of the consumable.

11. The method for controlling an image forming apparatus according to claim 7, further comprising:

selecting a function that corresponds to a key operated by a user, a plurality of keys corresponding to the plurality of functions, wherein, in a state where any one of the function being selected while a warning indication is being displayed on the display, a determination is made as to whether the selected function is the function of executing the operation involving use of the consumable, wherein the switching the contents displayed on the display is inhibited when the selected function is determined to be the function of executing the operation involving use of the consumable, and wherein the contents displayed on the display is switched when the selected function is determined not to be the function of executing the operation involving use of the consumable.

12. The method for controlling an image forming apparatus according to claim 7, wherein the plurality of functions includes a scanner function and a print function, and wherein when the scanner function is selected the warning indication is switched and when the print function is selected, the warning indication is not switched.

13. An image forming apparatus including a plurality of functions that include a function of executing an operation involving use of a consumable, the image forming apparatus comprising:

a display;

executed function selecting means for selecting one function to be executed from the plurality of functions;

display switching means for switching contents displayed on the display to information corresponding to the one function when the one function is selected by the executed function selecting means;

executed operation instructing means for instructing execution of an operation corresponding to the information displayed on the display as a result of the switching by the display switching means;

remaining level detection means for detecting a remaining level of the consumable;

warning indication provision means for displaying a warning indication on the display when the remaining level of the consumable detected by the remaining level detection means equal to or less than a predetermined level;

display switching inhibiting means for inhibiting the display switching means from switching the contents displayed on the display, for inhibiting displaying of information other than the warning indication, and for continuously displaying the warning indication on the display when the warning indication has been displayed for a predetermined time and the one function selected by the executed function selecting means is determined to be the function of executing the operation involving use of the consumable while the warning indication is displayed on the display by the warning indication provision means, wherein the display switching means switches the warning indication displayed on the display with the information other than the warning indication when the warning indication has been displayed for a predetermined time and the one function selected by the selecting unit is determined not to be the function of executing the operation involving use of the consumable while the warning indication is displayed on the display by the warning indication provision means.

14. The image forming apparatus according to claim 13, further comprising:

use restricting storage means for storing a plurality of pieces of identified information, each piece of the identified information corresponding to a function permitted to be used by a user from among the plurality of functions, wherein the one function selected by the executed function selecting means is a function being set by selecting one of the plurality of pieces of identified information stored in the use restricting storage means, and wherein, when the function of executing the operation involving use of the consumable is included in the function permitted to be used by the user and corresponded to the identified information selected by the executed function selecting means, the one function selected by the executed function selecting means is determined to be the function of executing the operation involving use of the consumable.

15. The image forming apparatus according to claim 14, wherein, in a state where the one of the plurality of pieces of identified information is being set, when the executed function selecting means selects a function other than a function of setting the identified information while a warning indication is being displayed on the display by the warning indication provision means, a determination is made as to whether selected one function is the function of executing the operation involving use of the consumable.

16. The image forming apparatus according to claim 13, further comprising:

set value changing means for changing a set value contained in the information corresponding to the one function selected by the executed function selecting means, wherein, when the set value is changed by the set value changing means, the display switching means switches the contents displayed on the display to information corresponding to the changed set value, and wherein the display switching inhibiting means inhibits the switching the contents displayed on the display when execution of one function selected by the executed function selecting means in the set value changed by the set value changing means involves use of the consumable.

17. The image forming apparatus according to claim 13, further comprising:

a plurality of keys corresponding to the plurality of functions, wherein the executed function selecting means selects a function that corresponds to a key operated by a user, wherein, in a state where any one of the function being selected while a warning indication is being displayed on the display by the warning indication provision means, a determination is made as to whether the selected function is the function of executing the operation involving use of the consumable, wherein the display switching inhibiting means inhibits the switching the contents displayed on the display when the selected function is determined to be the function of executing the operation involving use of the consumable, and wherein the display switching means switches the contents displayed on the display when the selected function is determined not to be the function of executing the operation involving use of the consumable.

18. The image forming apparatus according to claim 13, wherein the plurality of functions includes a scanner function and a print function, and wherein when the scanner function is selected the warning indication is switched and when the print function is selected, the warning indication is not switched.

* * * * *